US007824239B2

(12) United States Patent
Weinel et al.

(10) Patent No.: US 7,824,239 B2
(45) Date of Patent: Nov. 2, 2010

(54) RESCUE HARNESS

(75) Inventors: John T. Weinel, Lakeville, MN (US); Thomas Waclo, Olympic Valley, CA (US); Will Paden, Olympic Valley, CA (US); John Phillip Bowker, Minneapolis, MN (US)

(73) Assignee: Wari LLC, Olympic Valley, CA (US)

( * ) Notice: Subject to any disclaimer, the term of this patent is extended or adjusted under 35 U.S.C. 154(b) by 0 days.

(21) Appl. No.: 11/962,690

(22) Filed: Dec. 21, 2007

(65) Prior Publication Data

US 2009/0163095 A1 Jun. 25, 2009

(51) Int. Cl.
*B63C 9/08* (2006.01)

(52) U.S. Cl. ..... 441/114

(58) Field of Classification Search ..... 441/80, 441/83, 90, 87, 88, 91–101, 106, 108, 111–119, 441/121–123, 129, 131, 132, 136
See application file for complete search history.

(56) References Cited

U.S. PATENT DOCUMENTS 2,782,430 A * 2/1957 Radnofsky ..... 441/94
4,635,754 A * 1/1987 Aschauer et al. ..... 182/3
6,270,386 B1 * 8/2001 Visocekas ..... 441/80
7,261,608 B2 * 8/2007 Haddacks ..... 441/80
7,270,077 B2 * 9/2007 Beck ..... 116/210

FOREIGN PATENT DOCUMENTS

DE 2326850 * 5/1973
DE 19545864 A1 * 6/1997

* cited by examiner

*Primary Examiner*—Daniel V Venne
(74) *Attorney, Agent, or Firm*—Schwegman, Lundberg & Woessner, P.A.

(57) ABSTRACT

A. rescue harness including an inflatable bladder coupled with the harness near a harness upper back portion. The inflatable bladder is held in a stored position on the harness. In one example, the inflatable bladder includes at least first and second folds in the stored position. The first fold is configured to direct inflation of the inflatable bladder along a first direction away from a harness neck area. The second fold is configured to direct inflation of the inflatable bladder along a second direction substantially perpendicular to the first direction. The first and second folds are sized and shaped to direct inflation along the first direction and afterward direct inflation along the second direction. In another example, the rescue harness includes a deflector configured to direct the inflatable bladder away from the harness neck area during inflation and after inflation of the inflatable bladder.

17 Claims, 23 Drawing Sheets

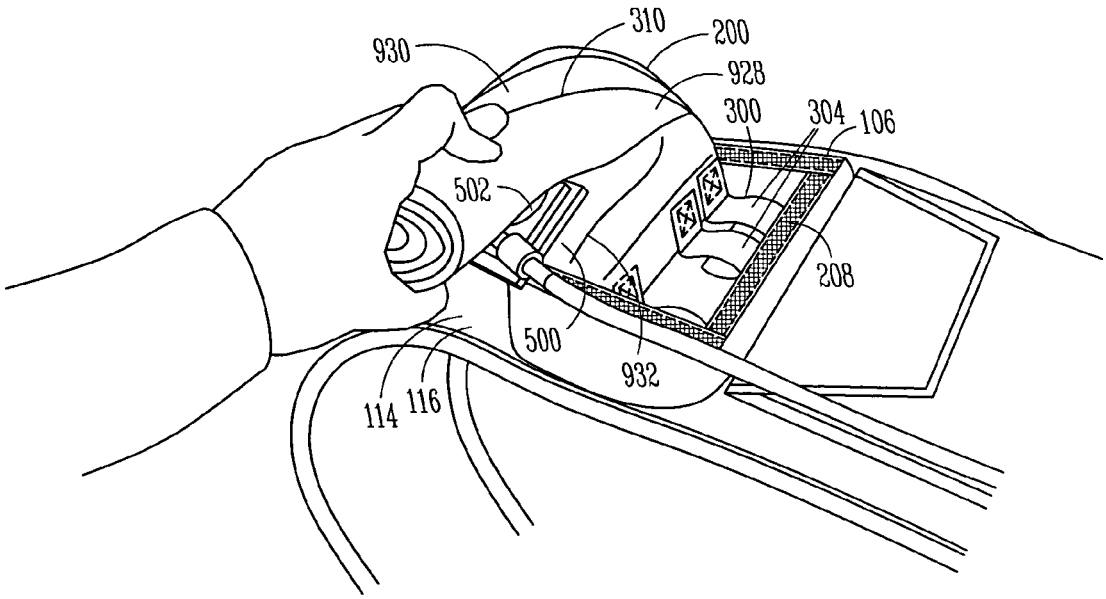
FIG. 9G1
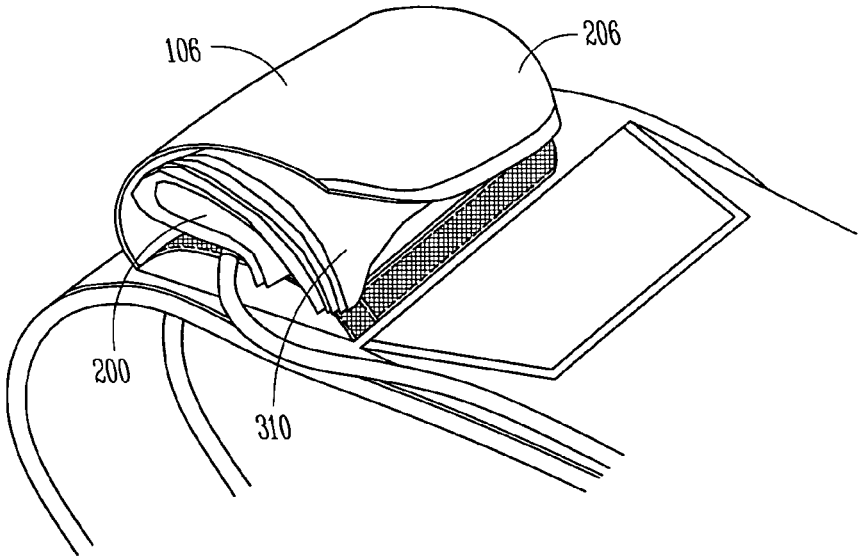
FIG. 9G2

RESCUE HARNESS

TECHNICAL FIELD

Emergency recovery devices and in particular emergency recovery devices usable in material slides such as landslides and avalanches.

BACKGROUND

Many current personal recovery and rescue devices are not compact and portable. A back mounted recovery device includes a large inflatable bladder and a gas canister coupled to the bladder. When inflated, a large bladder fixedly coupled with the user can impermissibly interfere with the mobility of the user. For instance, the bladder interferes with the use of the arms for skiing out of an avalanche. In another example, the bladder extends remotely outside of the silhouette of the user and can brush against tree limbs and other debris thereby interfering with the user's mobility while navigating through difficult terrain (wooded areas, landslides, avalanches and the like). In some examples, back mounted devices are heavy and limit the amount of equipment the user may comfortably carry in pockets and coats. In still other examples, it is the policy of ferrying services (e.g., helicopter ferries) that transport back country skiers and hikers to remote locations to not allow the use of a cumbersome backpack or back mounted recovery device that can decrease the mobility of the user in an avalanche situation.

In other examples, an inflatable bladder is retained along the hip with a gas canister coupled to the bladder. In one example, when inflated, the bladder remains coupled to the hip (i.e., with a tether), and the bladder can roll the user on to his side thereby pointing the face of the user into the material of the slide. Additionally, while moving in the material slide, because the inflated bladder is coupled at the hip (i.e., at the center of gravity of the user) the body of the user can rotate and the user's head may point downstream of the slide. The inflatable bladder thereby may not protect the head from injury caused by stationary trees, rocks and the like lying in the path of the material slide. Further, the inflated bladder attached by a tether can serve as an anchor becoming tangled in brush, debris and the like and hamper efforts by the user to navigate difficult terrain or get out of the path of a material slide.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

In this document, the terms "a" or "an" are used, as is common in patent documents, to include one or more than one. In this document, the term "or" is used to refer to a nonexclusive or, such that "A or B" includes "A but not B." "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

Figure 1A:
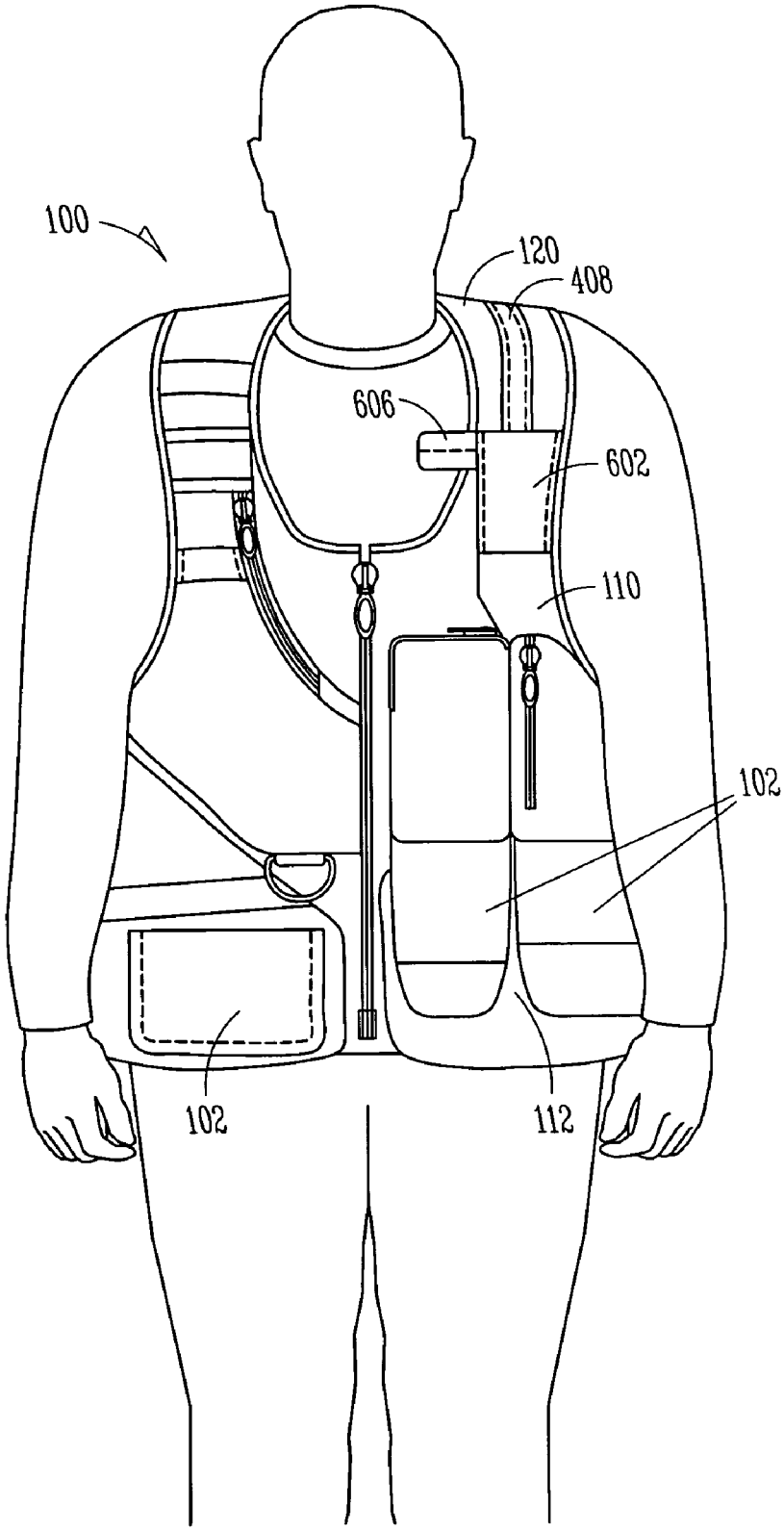
FIG. 1A is a front view of one example of a rescue harness.
Figure 1B:
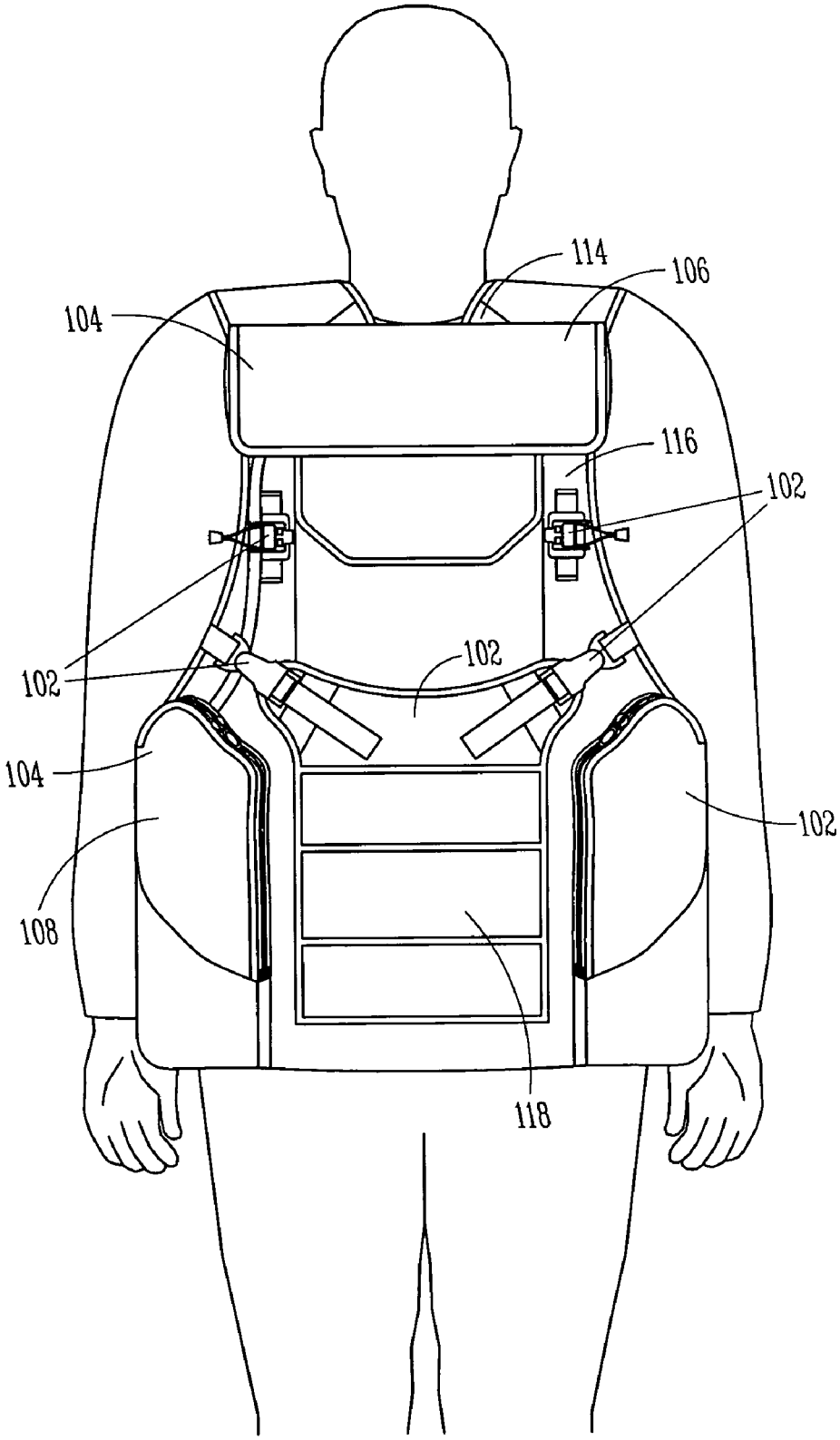
FIG. 1B is a back view of the rescue harness shown in FIG. 1A.
Figure 1C:
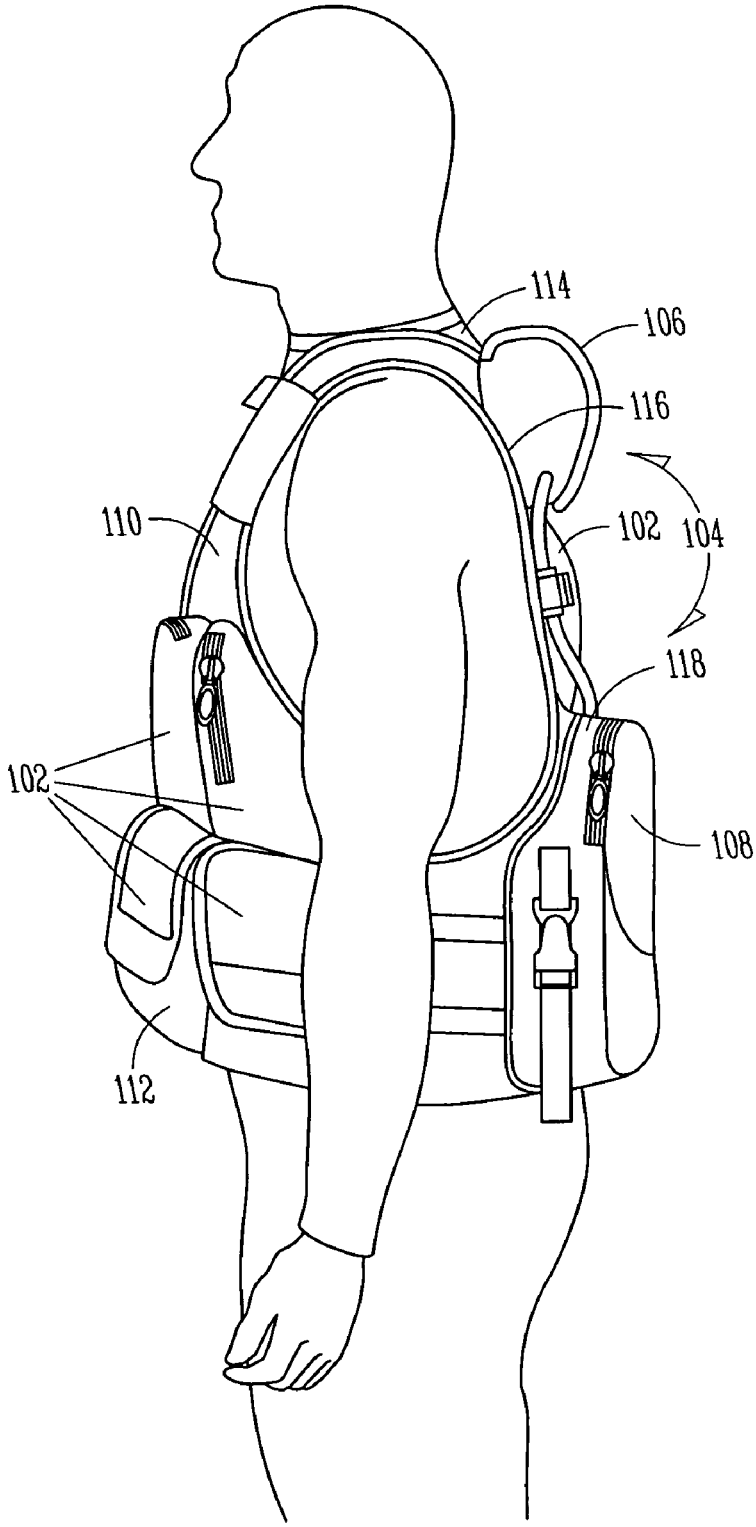
FIG. 1C is a side view of the rescue harness shown in FIG. 1A.

FIGS. 1A-C are front, back and side views, respectively, of a rescue harness 100. As shown in FIGS. 1A-C, in one example, the rescue harness 100 includes a vest having pockets, pouches, straps and tethers 102 for holding a variety of items needed by sportsmen and rescue personnel including hikers, skiers, snowboarders, avalanche rescue personnel, emergency rescue personnel and the like. The rescue harness has a harness chest portion 110, a harness abdomen portion 112, a harness neck portion 114, a harness upper back portion 116 and a harness lower back portion 118. In one option, the rescue harness 100 is configured along the harness upper back portion 116 and the harness lower back portion 118 to couple with a pack for storage of additional equipment. Optionally, the rescue harness 100 is configured to contain, but is not limited to, flares, a shovel, food, water, first aid supplies and the like.

The rescue harness 100 includes an inflation system housing 104 including, a gas canister pouch 108 and an inflatable bladder container 106. Either one or both of the gas canister pouch 108 and the inflatable bladder container 106 includes at least one of a pouch, casing, straps and the like sized and shaped to contain and store the gas canister and inflatable bladder (described below). The gas canister pouch 108 and the inflatable bladder container 106 are constructed with pliable materials similar to those used in the rescue harness 100 (e.g., NYLON™, polyester, canvas and the like). In another example, at least one of the gas canister pouch 108 and the inflatable bladder container 106 are constructed with rigid crush resistant materials, such as plastics, metals, composites and the like. As shown in FIGS. 1B, C, the gas canister pouch 108 is positioned on the rescue harness 100 near the harness lower back portion 118. The inflatable bladder container 106 is positioned near the harness upper back portion 116, and remote from the gas canister pouch 108. Optionally, the gas canister pouch 108 and the inflatable bladder container 106 are positioned near each other, for instance at the harness upper back portion. In another option, at least one of the gas canister pouch 108 and the inflatable bladder container 106 are positioned at the harness neck portion 114, harness lower back portion 118, harness chest portion 110 or the harness abdomen portion 112.

Figure 2:
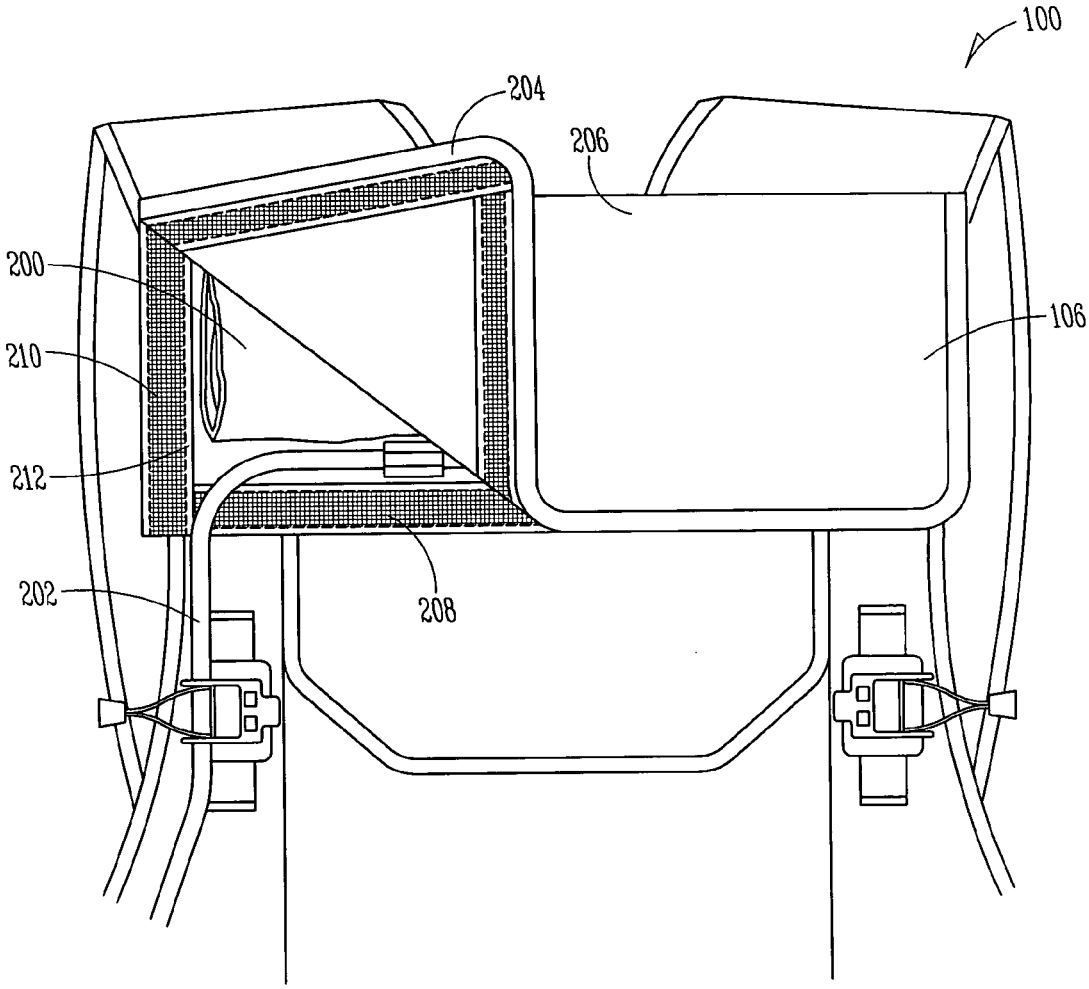
FIG. 2 is a detailed back view of the rescue harness showing one example of an inflatable bladder stored within a bladder container.

FIG. 2 shows one example of the inflatable bladder container 106. The inflatable bladder container 106 is sized and shaped to contain an inflatable bladder 200 in a stored position (e.g., in a rolled or folded configuration prior to inflation). A gas tube 202 runs from the gas canister pouch 108 (FIGS. 1B, C) to the inflatable bladder 200 to supply gas for inflation to the bladder 200.

The inflatable bladder container 106 is shown with a corner 204 opened of a container upper portion 206 to reveal the inflatable bladder 200. The container upper portion 206 couples with a container lower portion 208 to hold the inflatable bladder in the specified packing configuration prior to deployment. As shown in FIG. 2, the inflatable bladder container 108 includes coupling features 210 extending along at least a portion of the edge 212 of one of the container upper portion 206 and the container lower portion 208. Coupling features 210 include, but are not limited to, hook and loop material, snaps, rip-stitching, perforations, buttons and the like. The coupling features 210 are sized and shaped to open as the bladder 200 is inflated, allowing the bladder 200 to assume its full specified sized and shape. As described above, the inflatable bladder container 106 is constructed with pliable materials in one example. In another example, at least a portion of the inflatable bladder container 106 is constructed with rigid materials such as plastics, metals, composites and the like. As described below, at least a portion of the container upper portion 206 (pliable or rigid) is used as a deflector to constrain movement of the bladder 200 toward the harness neck area 114 (FIGS. 1B, C) and the head of a user. That is to say, the container upper portion helps prevent movement of the bladder 200 toward the harness neck area 114 and the user's head at least during inflation.

Figure 3:
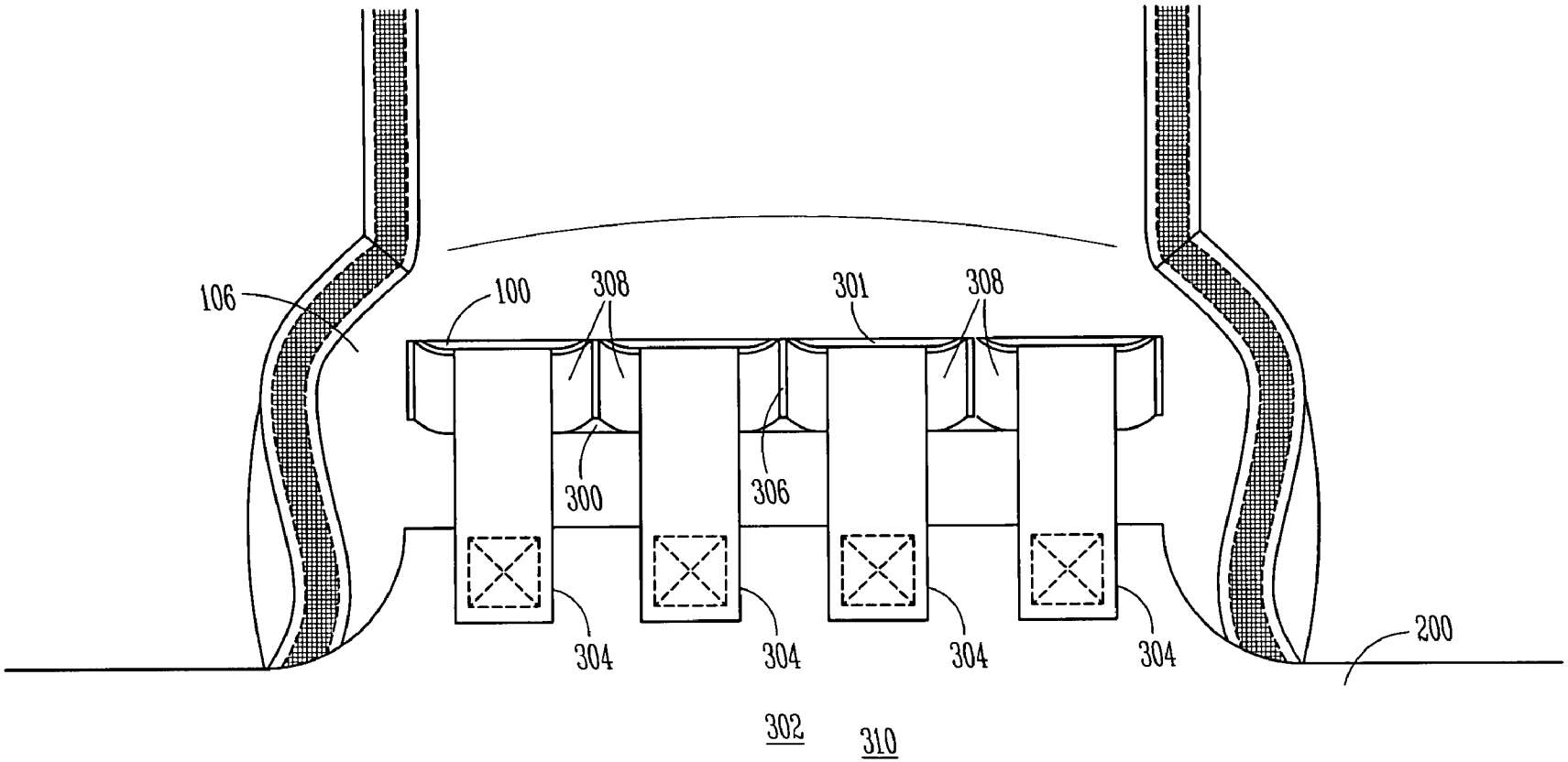
FIG. 3 is a detailed view of a bladder joint coupling a proximal end of the inflatable bladder with the harness.

FIG. 3 is a detailed view of the bladder joint 300 that movably couples a proximal end 302 of the inflatable bladder 100 with the rescue harness 100. As shown, the bladder joint 300 extends through an orifice 301 in the inflatable, bladder container 106 to directly couple with the harness 100. In another example, the bladder joint 300 is coupled with the material of the inflatable bladder container 106, and the container 106 is coupled with the rescue harness 100. The bladder joint 300 retains the bladder 200 near the rescue harness 100 allowing the bladder 200 to pull the harness 100 and the user toward the surface of a material slide when deployed. As shown, the bladder joint 300 couples the inflatable bladder 200 adjacent to the harness upper back portion 116 (FIGS. 1B, C). As described in detail below, coupling the bladder 200 near the harness upper back portion 116 allows the bladder 200, in an inflated condition, to preferentially pull the user's upper body and head toward the surface of a material slide making it easier for the user to breach the material slide because of the bladder buoyancy or dig himself out after the material slide.

In one example, the bladder joint 300 includes multiple straps 304 that are coupled with a brace 306 to form a bladder hinge joint. The brace 306 includes hoops 308 sized and shaped to receive the straps 304. The brace 306 is coupled with the rescue harness 100. In another example, the bladder joint 300 includes a hinge, such as a living hinge formed with a single piece of material (e.g., plastic, fabric and the like). In still another example, the bladder joint 300 includes a hinge, such as a mechanical hinge including a harness side bracket and a bladder side bracket. The brackets are coupled together similarly to a door hinge to allow rotation of the inflatable bladder 200. The bladder joint 300 acts as a robust coupling between the rescue harness 100 and the inflatable bladder 200 to substantially prevent forced removal of the bladder 200 from the harness during a material slide. The bladder joint 300 allows movement of the inflatable bladder 200 (e.g., rotation of the bladder from a distal end 303 toward the proximal end 302) with respect to the rescue harness 100. Movement of the bladder 200 relative to the harness 100 minimizes interference of the bladder with the activities of the user. For instance, the user may continue with activities such as skiing, snowboarding, snowmobiling, hiking and the like to get out of the way of a material slide while the bladder 200 is in an inflated condition and movable behind the user.

Figure 4:
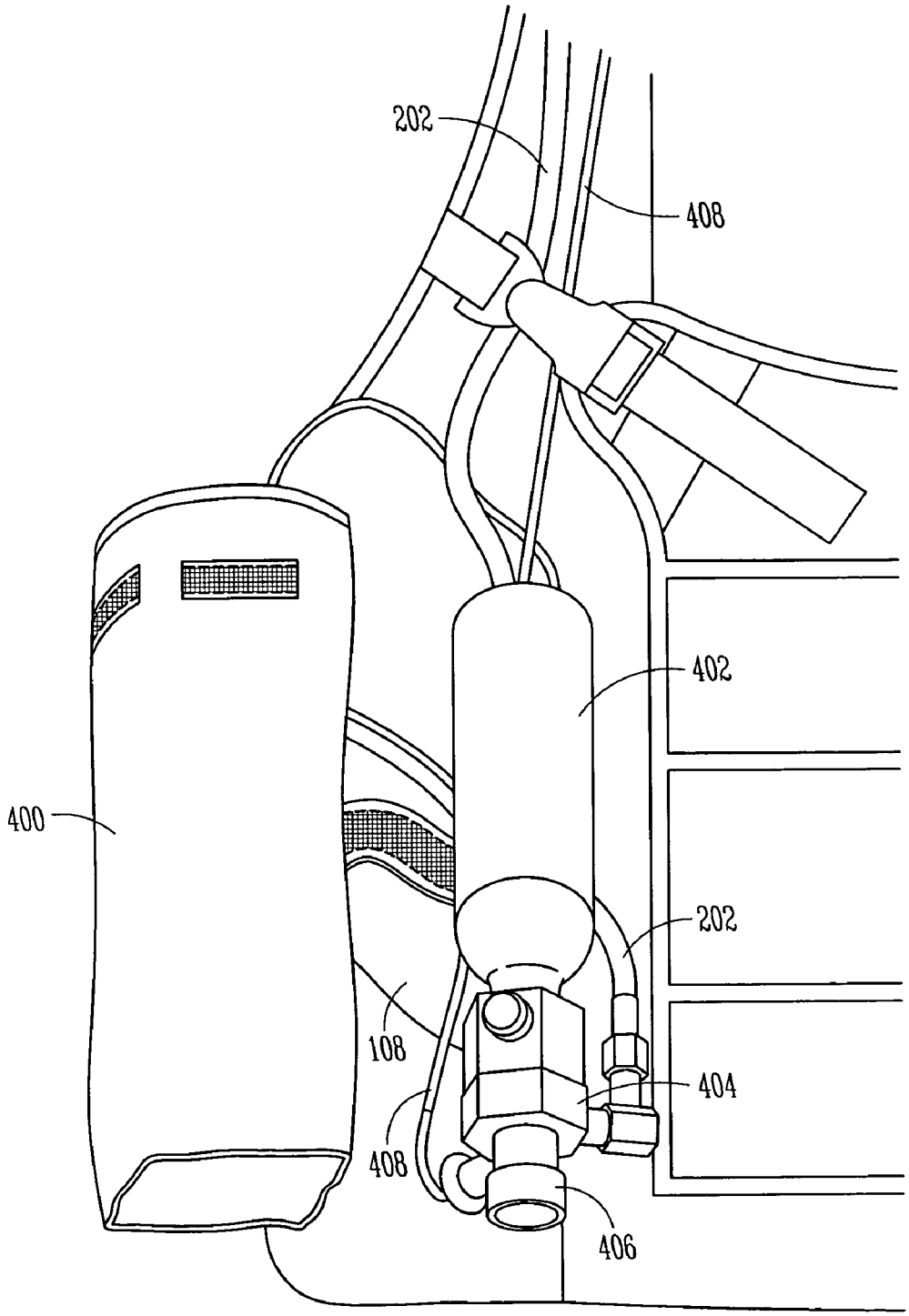
FIG. 4 is a second detailed back view of the rescue harness showing one example of an inflation system having a gas container assembly coupled with the inflatable bladder by flexible tubing.

FIG. 4 shows a detailed view of the gas canister pouch 108 in an open condition. The gas canister pouch 108, in one example, includes a canister liner 400. The canister liner 400 has been removed from the pouch 108, and the gas canister 402 has been removed from the canister liner 400 to aid in description. The canister liner 400 provides a protective sleeve to the gas canister 402 protecting the canister 402 from violent contact with objects during activities (hiking, skiing, snowmobiling and the like) and material slides. The gas canister 402 contains pressurized gas including, but not limited to, nitrogen, carbon dioxide, air and the like.

The gas canister 402 includes a discharge nozzle 404, and an activation housing 406. The discharge nozzle 404 funnels gas from the canister 402 in an opened state to the gas tube 202. Gas from the gas tube 202 is delivered to the inflatable bladder 200 (FIG. 2). The activation housing 406 includes an opening mechanism configured to open the gas canister 402. The opening mechanism includes, but is not limited to, the following functions: puncturing the canister, pulling a plug out of the canister, shearing off a portion of the canister, chemically dissolving a portion of the canister and the like. An activator 408 is coupled with the activation housing 406. The activator 408 is operated to trigger the activation housing 406 and thereby begin inflation of the inflatable bladder 200. As shown in FIG. 4, the activator 408 includes a rip cord.

Figure 5:
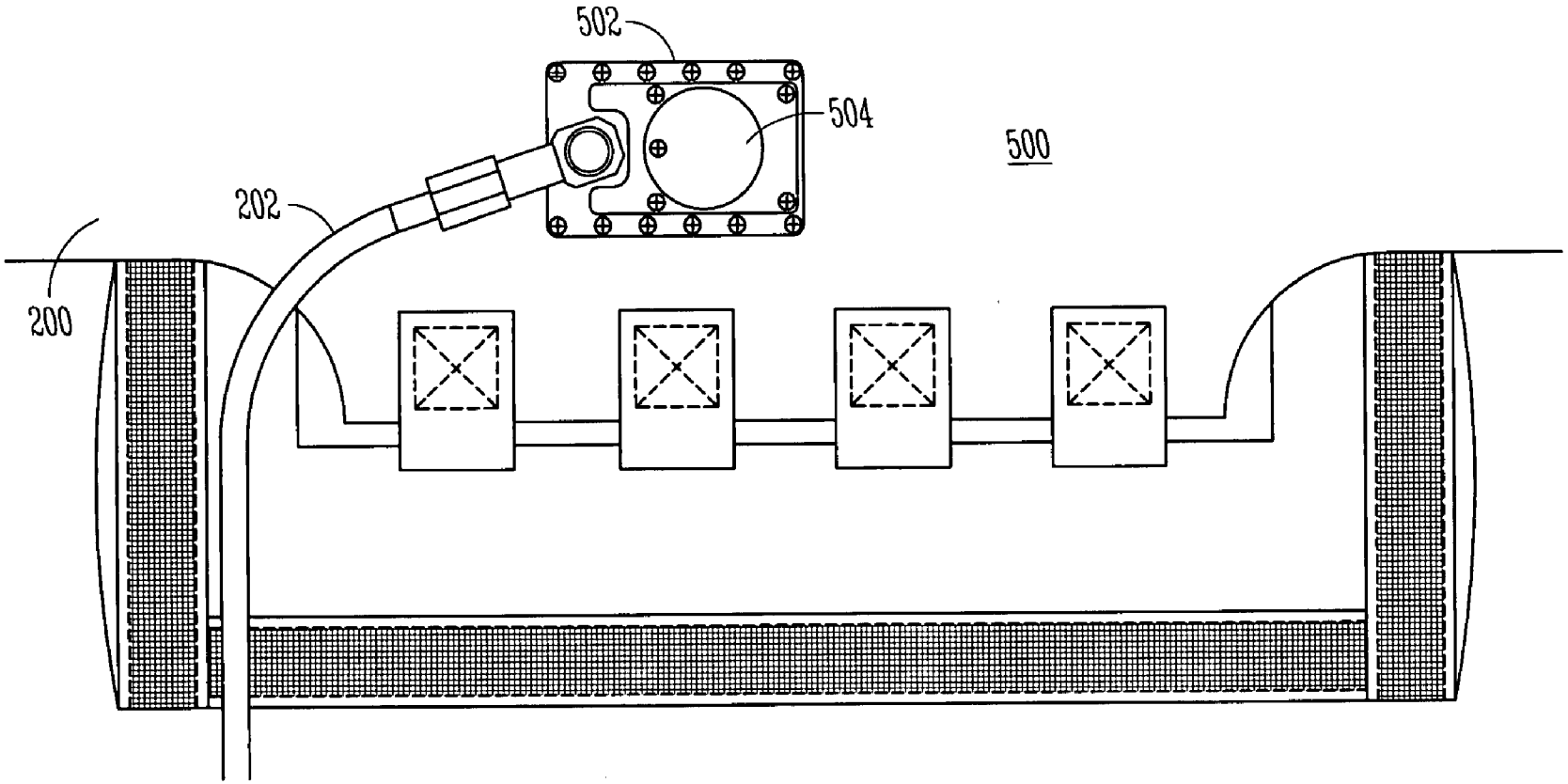
FIG. 5 is a detailed view of the inflatable bladder showing one example of a venturi coupled with the bladder and the flexible tubing.

Referring now to FIG. 5, the gas tube 202 is shown coupled with a second bladder face 500 of the inflatable bladder 200 by way of a venturi 502. The venturi 502 cooperates with an in flow of gas from the canister 402 and through a venturi effect draws air into the venturi to combine with the gas and inflate the inflatable bladder 200. Use of the venturi 502 allows for use of a smaller gas canister 402 as ambient air is used to aid in inflation. The smaller gas canister 402 thereby minimizes the weight of the rescue harness 100 making the harness 100 less cumbersome. The venturi 502 includes a dump valve 504. When desired the dump valve 504 is operated (e.g., by pushing on the valve tab) to open the valve 504 and release gas in the bladder 200. A user can thereby quickly deflate an inflated bladder 200 to assist in movement after inflation (e.g., after the user has extricated himself from a material slide).

The venturi 502 is coupled along the second bladder face 500 to distance the venturi 502 from the harness neck area 114 (FIGS. 1B, C) and the head of a user. The second bladder face 500 is more distant than an opposed first bladder face 310 (See FIG. 3) that is interposed between the venturi 502 and the harness neck area 114 and the user's head. During inflation and violent movement through a material slide, the position of the bladder 200 between the venturi 502 and the user's head helps to prevent contact between the venturi 502 and the head.

Figure 6:
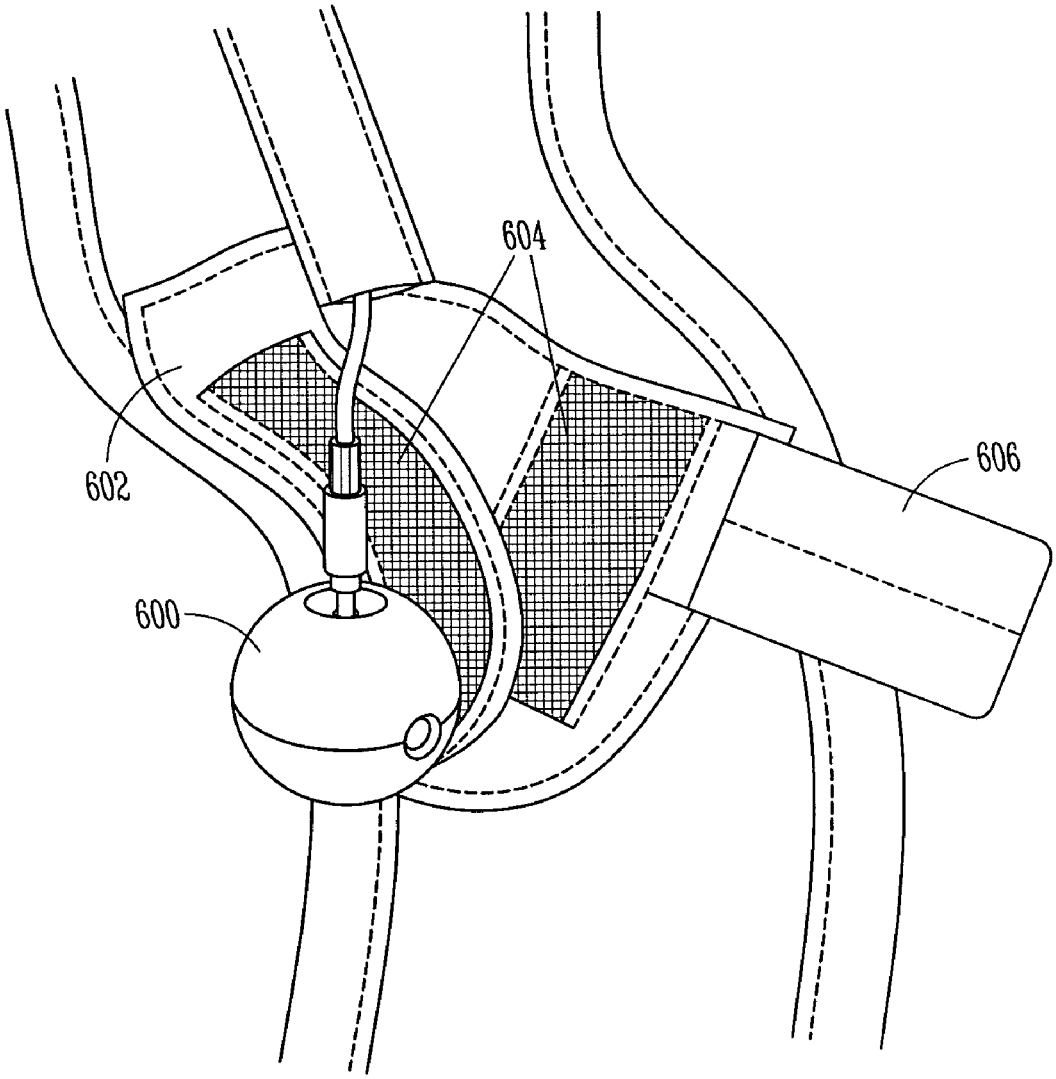
FIG. 6 is a detailed view of one example of a trigger mechanism coupled with the inflation system.

Referring now to FIGS. 1A and 6, in one example, the activator 408 extends over a harness shoulder portion 120 (See FIG. 1A). The activator 408 terminates at a handhold 600 (FIG. 6). To inflate the bladder 200, the user pulls the handhold 600, which in turn pulls the activator 408 (e.g., a rip cord shown in FIG. 4) and activates the activation housing 406 to open the gas canister 402. The handhold 600 is retained along the harness shoulder portion 120 by a handhold flap 602 shown in FIGS. 1A and 6. The handhold flap 602 lays over the handhold 600 and substantially prevents accidental manual activation by tightly holding and concealing the handhold 600 along the harness shoulder portion 120. The handhold flap 602 is held over the handhold 600 by at least one coupling feature 604 including, but not limited to hook and loop material, snaps, rip-stitching, perforations, buttons and the like. In another option, the handhold flap 602 includes a easily identifiable pull tab 606 that allows for quick removal of the handhold flap 602 in an emergent situation (e.g., during a material slide). The pull tab 606 may be marked with, but is not limited to, incandescent stitching, incandescent paint, bright coloring, contrasting color to the rescue harness, a differing texture relative to the rescue harness and the like.

Figure 7A:
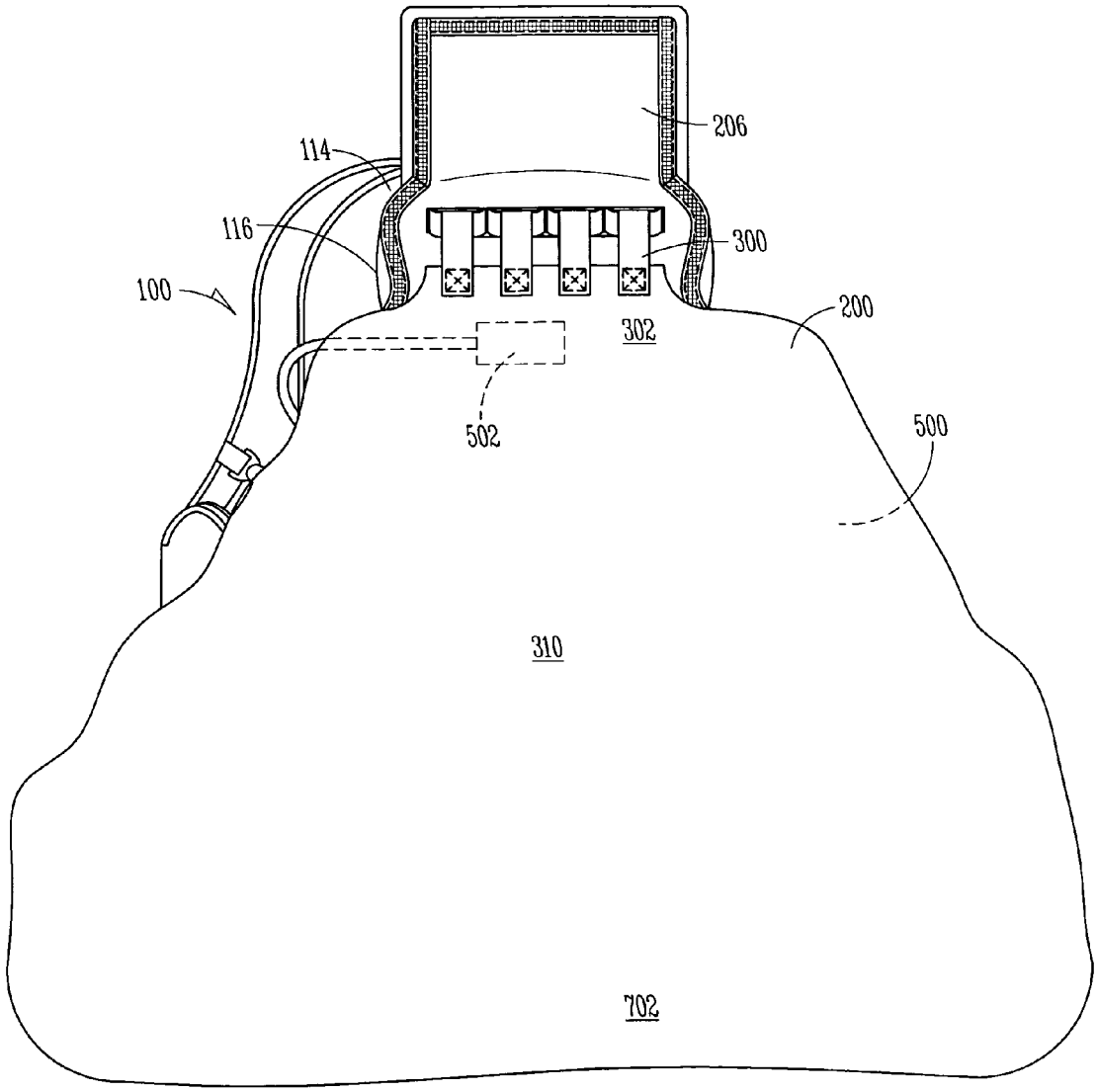
FIG. 7A is a perspective view of the rescue harness with the inflatable bladder in a deployed condition.

FIG. 7A shows the rescue harness 100 with the inflatable bladder 200 in a deployed but uninflated condition for ease of viewing the bladder joint 300. As previously described the bladder proximal end 302 is coupled with the harness upper back portion 116 by the bladder joint 300. The bladder 200 is thereby able to move, rotate for instance, around the bladder joint 300 allowing the user improved mobility of the arms and torso.

Figure 7B:
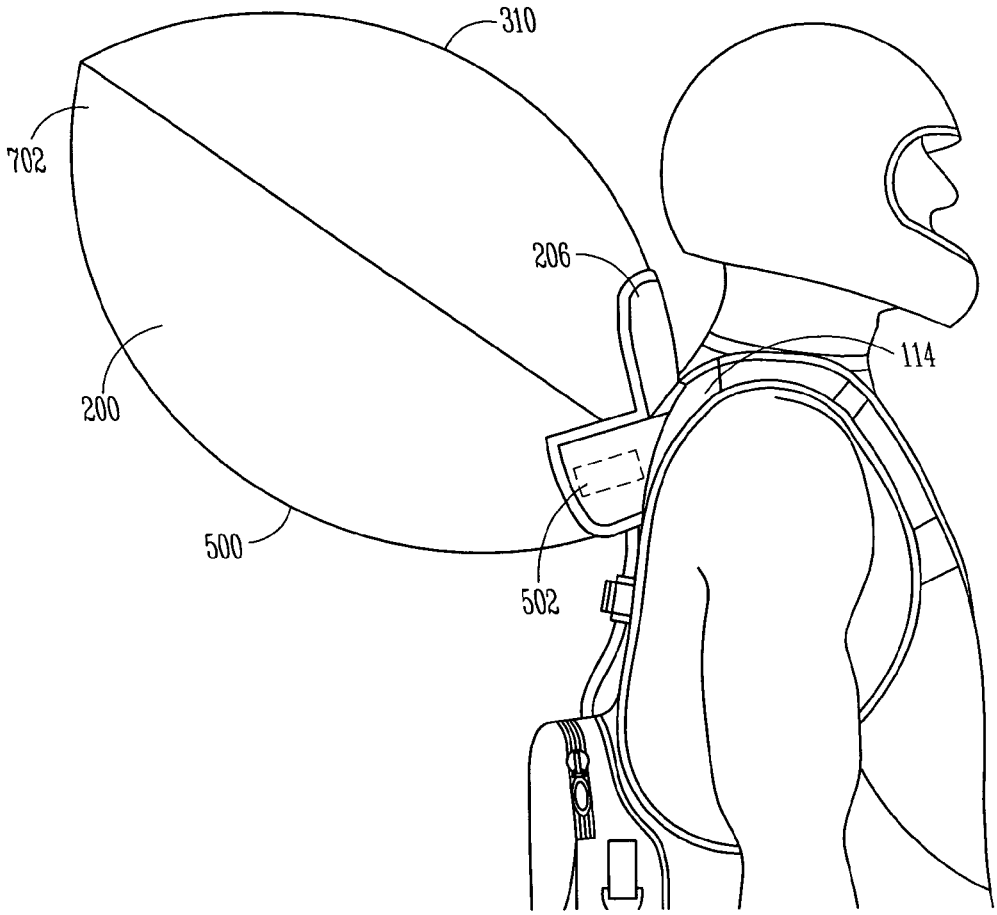
FIG. 7B is a detailed view of another example of the rescue harness with the inflatable bladder in a deployed and inflated condition.

As described above and shown in FIGS. 7A, B, a portion of the container upper portion 206 is used as a deflector to constrain movement of the bladder 200 toward the harness neck area 114. FIG. 7B shows the rescue harness in the deployed and inflated condition. In one example, the container upper portion 206 is constructed with, but not limited to, plastics, fabric and the like, and is pliable. The pliable container upper portion 206 is interposed between the bladder 200 and the harness neck area 114 (as well as the user's head) to substantially prevent rotation and engagement of the bladder 200 with the head of the user. In another example, the container upper portion 206 is substantially rigid and constructed with, but not limited to, hard plastics, composites, metal and the like. Similarly to the pliable container upper portion 206, the rigid container upper portion 206 is interposed between the bladder 200 and the harness neck area 114 (as well as the user's head) and substantially prevents rotation and engagement of the bladder 200 with the head of the user. Additionally, the rigid container upper portion 206 provides a structural abutment that intercepts and substantially prevents movement of the bladder 200 toward the harness neck area 114 and the head of the user. The rigid container upper portion 206 is configured to engage with the harness upper back portion 116 to substantially prevent it from rotating into the user's head. In another example, the rigid container upper portion 206 is coupled with the harness upper back portion 116 with a mechanical hinge sized and shaped to provide a limited travel to the container upper portion 206.

Figure 7C:
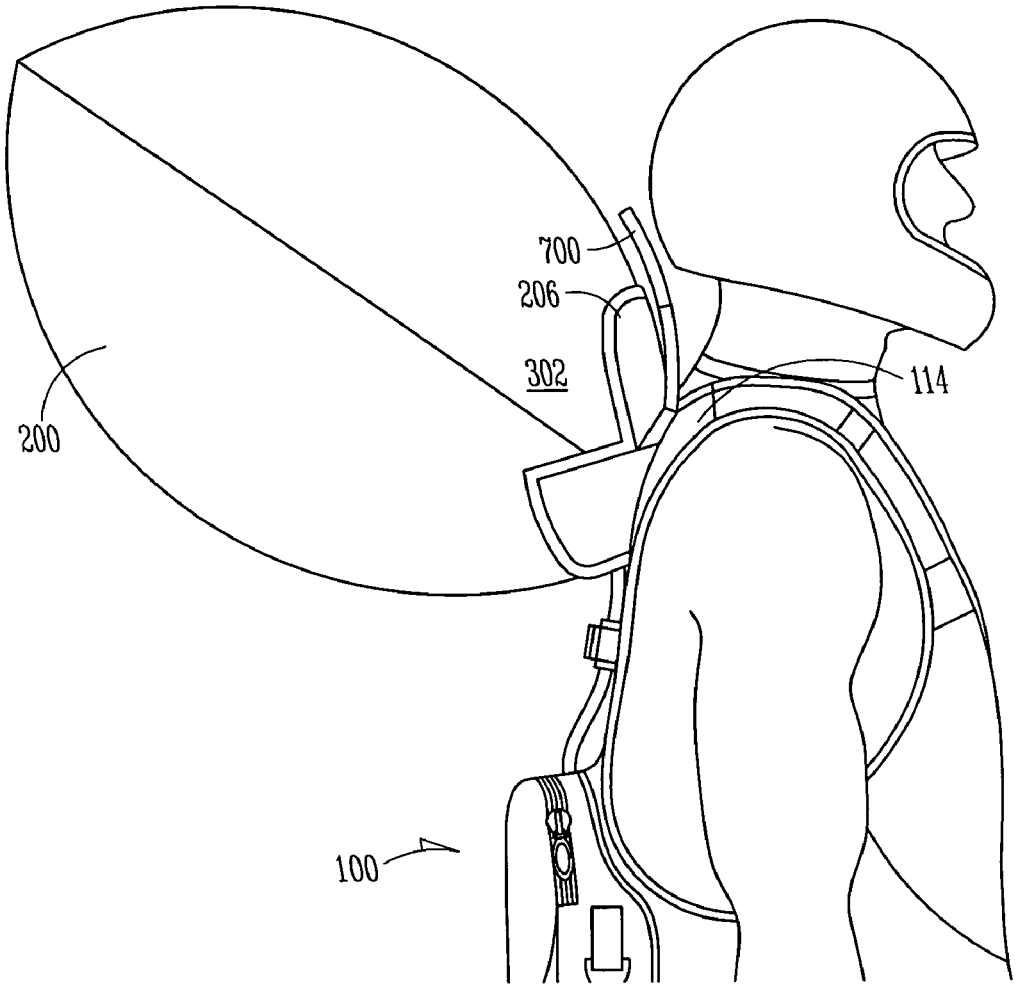
FIG. 7C is a side view of yet another example of the rescue harness with the inflatable bladder in a deployed condition with a deflector separate from the bladder container.

In still another example shown in FIG. 7C, the rescue harness 100 includes a deflector 700 (e.g., rigid or pliable) separate from the bladder container 106. As described above with regard to the container upper portion 206, the separate deflector 700 performs the same functions of deflecting movement of the bladder 200 away from the harness neck area 114 and the head of the user during inflation (deployment) and subsequent use.

The deflector 700 and container upper portion 206 assist in preventing contact with the head during deployment (e.g., inflation) by directing inflation of the bladder 200 away from the harness neck area 114 and the user's head. Additionally, the deflector 700 and the container upper portion 206 deflect the inflatable bladder 200 away from the harness neck area 114 and the user's head during use of the rescue harness 100, such as during a material slide, hiking, skiing, snowmobiling, rescue operations and the like.

As shown in FIGS. 7A, B, the venturi 502 is coupled along a second bladder face 500 opposed to a first bladder face 310. The first bladder face 310 is relatively closer to the harness neck area 114 than the second bladder face 500. Similarly, the venturi 502 is thereby positioned away from the harness neck area 114 and the user's head. The first bladder face 310 ensures the venturi 502 cannot directly contact the harness neck area 114 or the head of the user by rotation of the inflatable bladder 200 (e.g., the bladder 200 including the bladder distal end 702) around the bladder joint 300 (see arrows in FIG. 7B). Additionally, the inflated bladder 200 provides a cushion against forced engagement of the venturi 502 against the harness neck area 114 and the user's head because the bladder 200 is interposed between the venturi and the harness neck area (and the user's head). The harness neck area 114 and the head of the user are thereby protected from collisions with the venturi 502 during inflation and use of the inflatable bladder 200.

Figure 8:
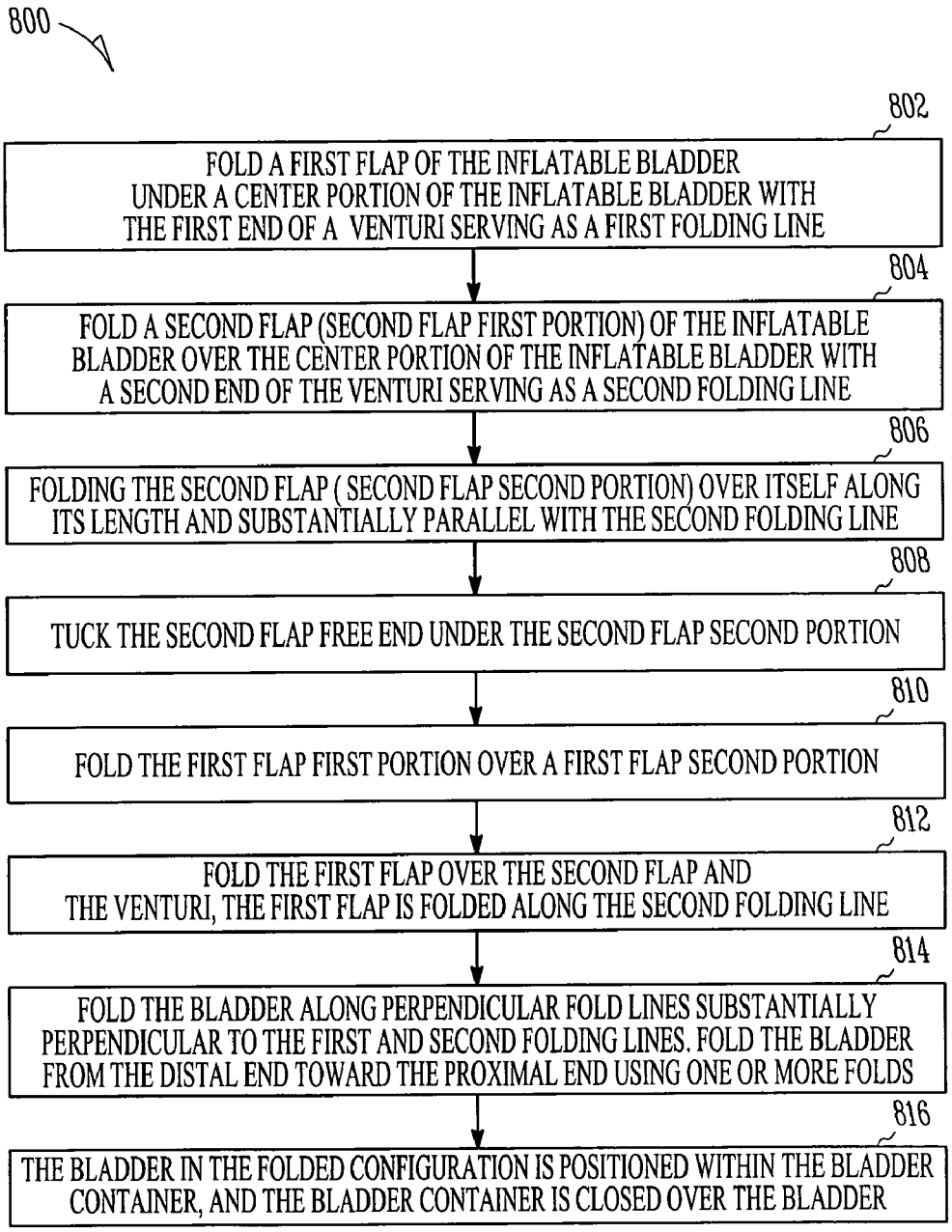
FIG. 8 is a block diagram showing one example of a method for packing an inflatable bladder.
Figure 9A:
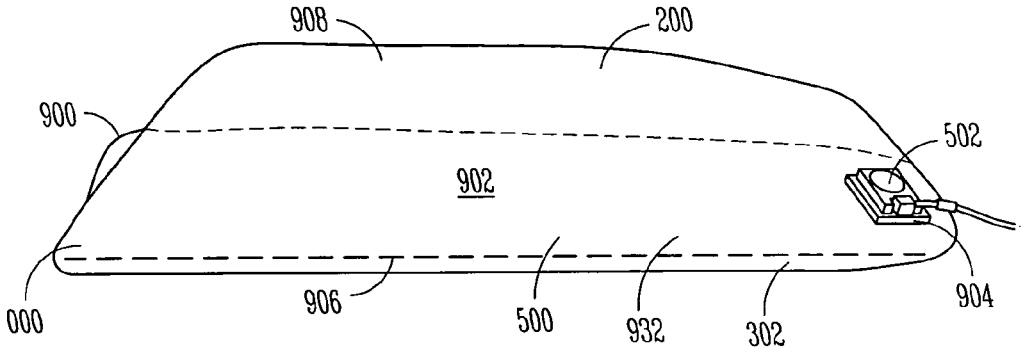
FIGS. 9A-G2 are detailed views of the inflatable bladder during examples of packing steps.
Figure 9B:
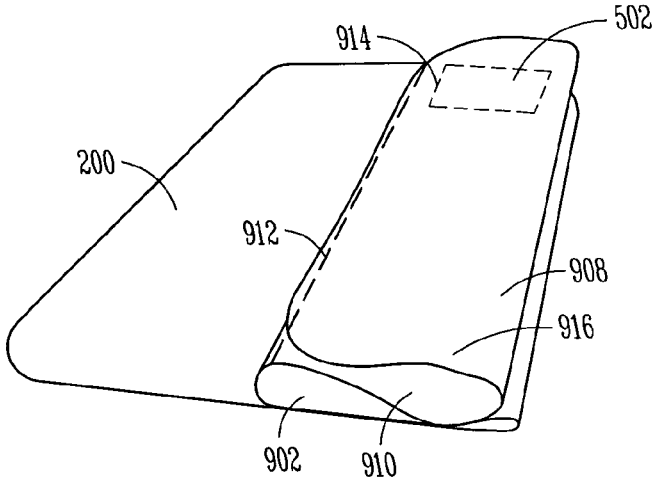
Figure 9C:
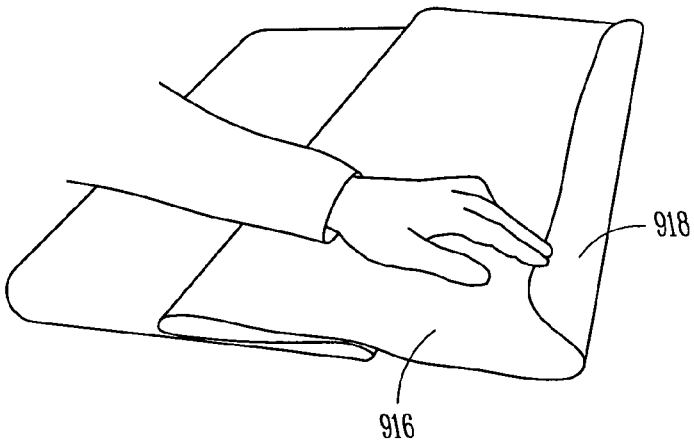
Figure 9D:
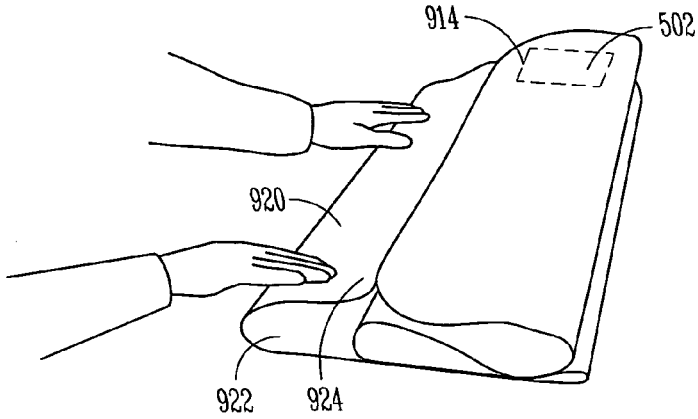
Figure 9E:
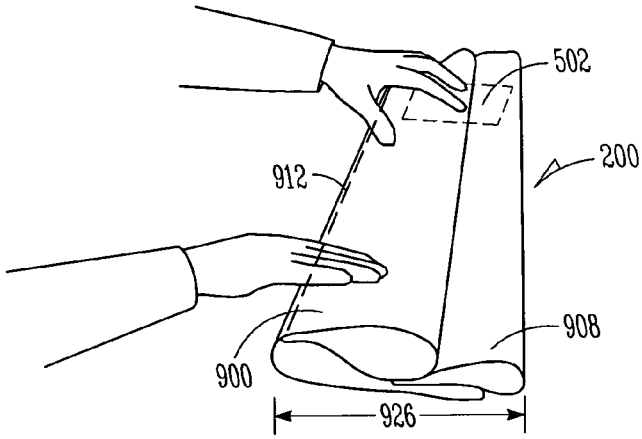
Figure 9F:
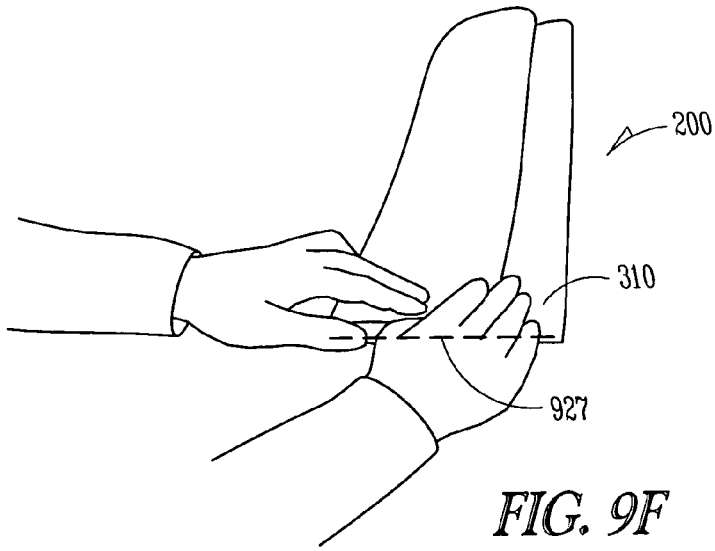

FIG. 8 is a block diagram showing one example of a method 800 for packing an inflatable bladder of a rescue harness, such as the rescue harness 100 shown in FIGS. 1-7C. Additionally, FIGS. 9A-9G2 show the various packing steps of the method 800. FIGS. 1-7C and 1-9G2 are referred to in the description of the method 800 below. At 802, a first flap 900 (FIG. 9A) of the inflatable bladder 200 is folded under a center portion 902 of the bladder, and a first end 904 of the venturi 502 generally marks a first folding line 906 extending between the bladder proximal end 302 and the bladder distal end 702. At 804, a second flap 908 (FIGS. 9A, B), such as a second flap first portion 910 (FIG. 9B), is folded over the center portion 902 of the bladder 200 along a second fold line 912 with a second end 914 of the venturi 502 generally marking the second fold line 912. At 806, a second flap second portion 916 (FIG. 9B) is folded over the second flap first portion 910. The second flap second portion 916 is folded along its length substantially parallel with the second fold line 912. The venturi 502 is substantially concealed with the venturi first end 904 at least partially exposed. At 808, a second flap free end 918 is optionally tucked under the second flap second portion 916 (FIG. 9C). The second flap second portion 916 is then oriented as seen in FIG. 9B. Step 808 may be combined with step 806. At 810, a first flap first portion 920 is folded over a first flap second portion 922 (FIG. 9D). For example, the first flap free end 924 is adjacent the second end 914 of the venturi 502 at step 810. At 812, the first flap 900 is folded over the second flap 908 and the venturi 502 (FIG. 9E). In one example, the first flap 900 is folded along the second fold line 912. In another example, the venturi 502, shown in phantom lines, is disposed relatively beneath the inflatable bladder 200. The width 926 of the bladder 200 is now packed to fit within the bladder container 106 in a first packing configuration using the one or more folds described above. At 814, the inflatable bladder 200 is folded into a second packing configuration along at least one fold line 927 that is perpendicular to the previously described folds (FIG. 9F). For instance, the inflatable bladder 200 is folded parallel to the width 926. In another example, the inflatable bladder 200 is folded multiple times along multiple fold lines toward the bladder proximal end 302. The inflatable bladder 200 is thereby rolled toward the bladder proximal end 302 and the bladder container 106. Optionally, folding the bladder 200 into the second packing configuration includes continuously rolling the inflatable bladder 200 toward the bladder proximal end 302. At 816, the bladder 200 in the folded configuration (FIGS. 9G1, 9G2) is positioned within the bladder container 106 with the bladder positioned over the venturi 502. Referring to FIGS. 9G1 and 9G2, the bladder 200 in the stored configuration is positioned over the bladder joint 300, such as the straps 304. The pliable bladder joint 300 allows for easy covering of the joint 300 to facilitate packing of the bladder 200 within the bladder container 106. In other example, rigid bladder joints are configured to have sufficient flexibility to allow for positioning of the bladder 200 within the bladder container 106, and also allow limited rotation around the bladder joint. The bladder container 106 is then closed over the bladder 200 to hold the bladder prior to deployment. As described above, and shown in FIG. 2, the bladder container 106 includes a container upper portion 206 and container lower portion 208. The bladder container 106 is closed over the inflatable bladder 200 with coupling features 210 configured to split upon deployment of the bladder 200.

As shown in FIG. 9G1, in a stored (e.g., rolled configuration), the inflatable bladder 200 is positionable within the bladder container 106. The inflatable bladder 200 is interposed between the venturi 502 and the harness neck area 114 to substantially prevent contact between the venturi 502 and the user's head during deployment. Referring to FIGS. 9A, 9F, 9G1 and 9G2, and as previously described above, the venturi 502 is coupled with the second bladder face 500 and is opposed to the first bladder face 310 (also shown in FIG. 3). The second bladder face 500 is more distant for the harness neck area 114 and the user's head than an opposed first bladder face 310. During inflation and violent movement through a material slide, the position of the bladder 200 between the venturi 502 and the user's head helps to prevent contact between the venturi 502 and the head. The first bladder face 310 is thereby maintained on the exterior 930 of the bladder 200 in the stored configuration to ensure the venturi 502 (positioned on the bladder interior 932) is separated from the harness neck area 114. For instance, when the bladder 200 is rolled into the stored configuration, the first bladder face 310 is folded (e.g., rolled) over the second bladder face 500 to ensure separation between the harness neck area 114 and the venturi 502.

The bladder leading edge 928 is shown pointing down from the upper back portion 116 toward the harness lower back portion 118 (See FIG. 9G1). As described in more detail below, the bladder leading edge 928 is directed away from the harness neck area 114 to correspondingly direct at least initial inflation of the bladder 200 away from the harness neck area and the user's head.

Several options for the method 800 follow. In one option, the method 800 is part of a general method for making a rescue harness, such as rescue harness 100. For instance, the method for making the harness 100 includes coupling the bladder proximal end 302 to the harness at the bladder joint 300 so that the bladder distal end 702 and at least a portion of the bladder 200 are rotatable relative to rescue harness 100. In another option, an inflation trigger mechanism, such as the activator 408 is coupled with the activation housing 406, and the housing 406 is coupled in turn with the gas canister 402 (See FIG. 4). In yet another option, the method 800 includes coupling a bladder deflector 700 with the rescue harness 100, as shown in FIG. 7C. For instance, the bladder deflector 700 is coupled between the bladder proximal end 302 and the harness neck area 114. The bladder deflector is configured to constrain movement of the inflatable bladder 200 in an inflated condition toward the harness neck area 114 (i.e., helps prevent movement of the bladder 200 toward the harness neck area). The method further includes coupling the bladder deflector as the container upper portion 206 (FIG. 2) over the inflatable bladder 200 in the stored position. The container upper portion 206 is sized and shaped to hold the bladder 200 adjacent the harness upper back portion 116.

Figure 10:
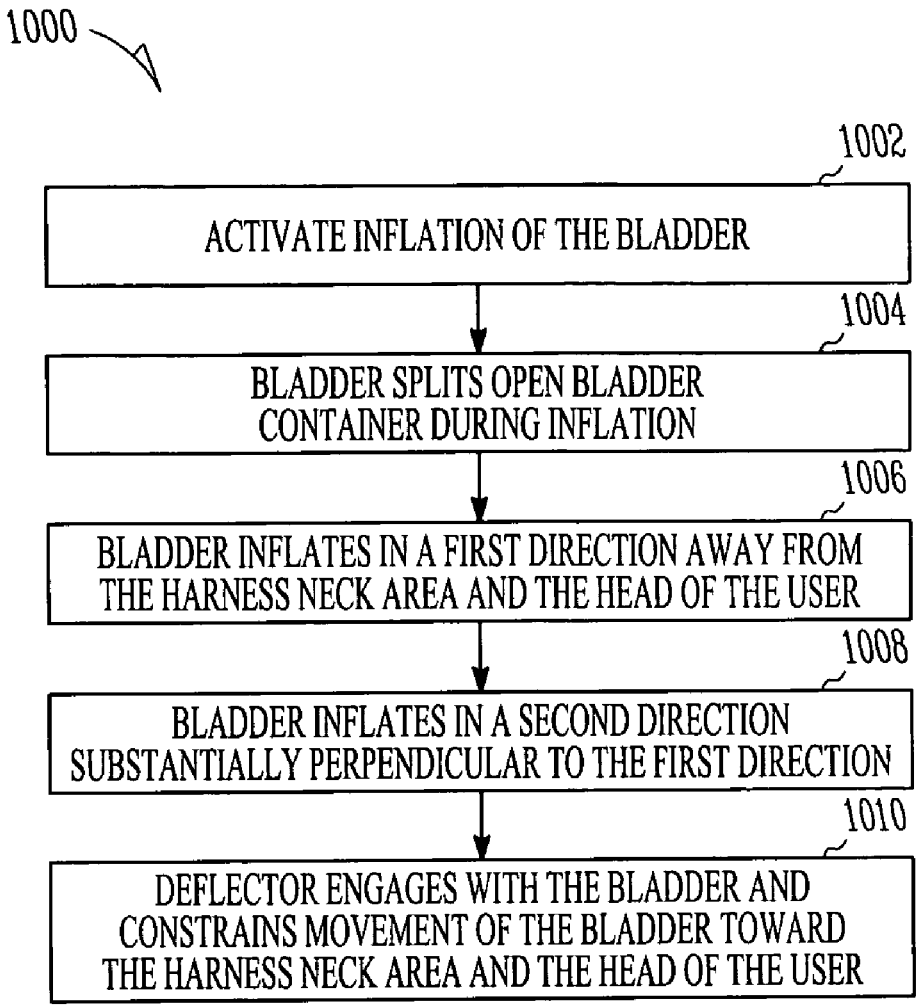
FIG. 10 is a block diagram showing one example of a method for using a rescue harness.
Figure 11A:
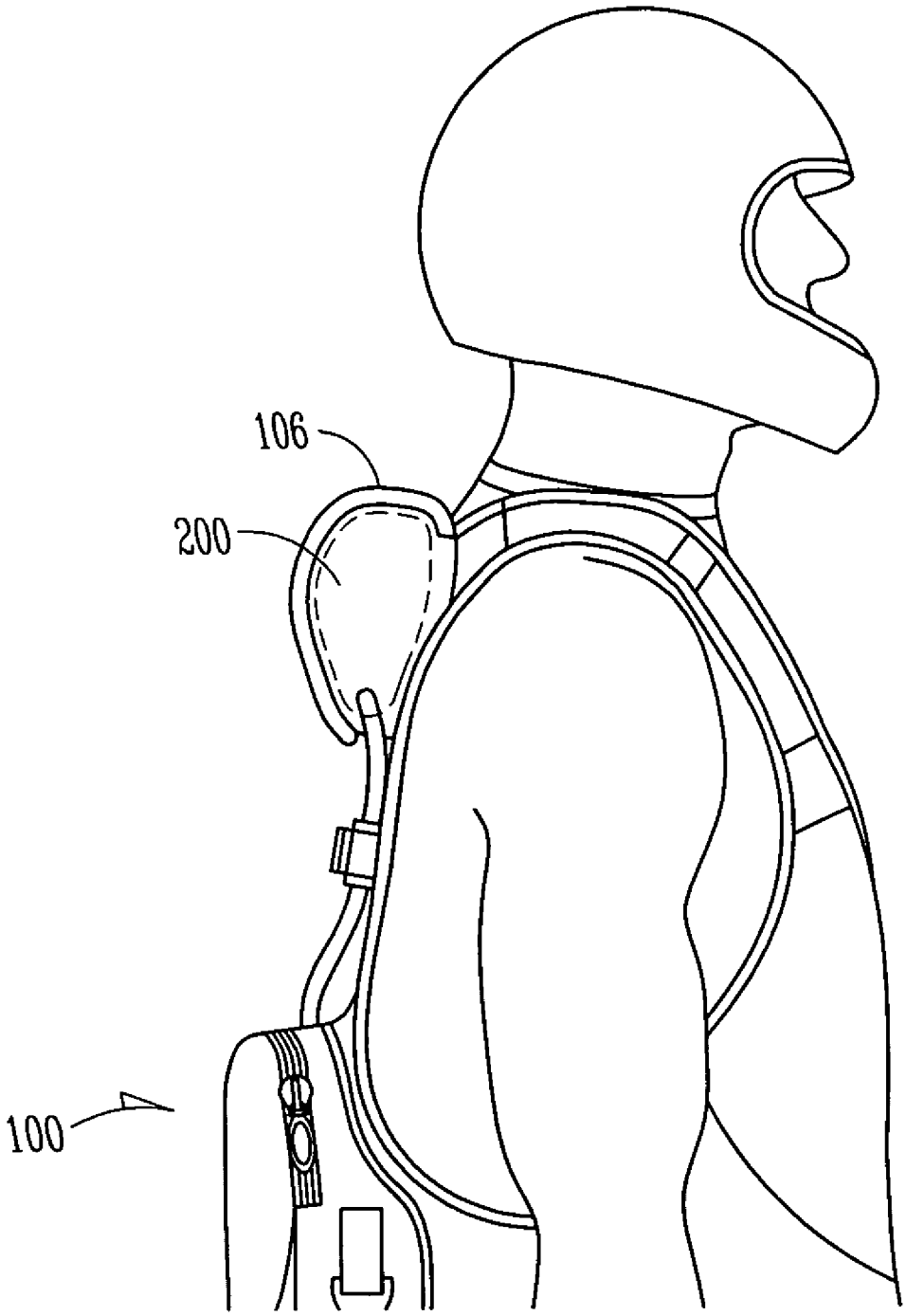
FIGS. 11A-F are detailed view of the inflatable bladder during stages of deployment.
Figure 11B:
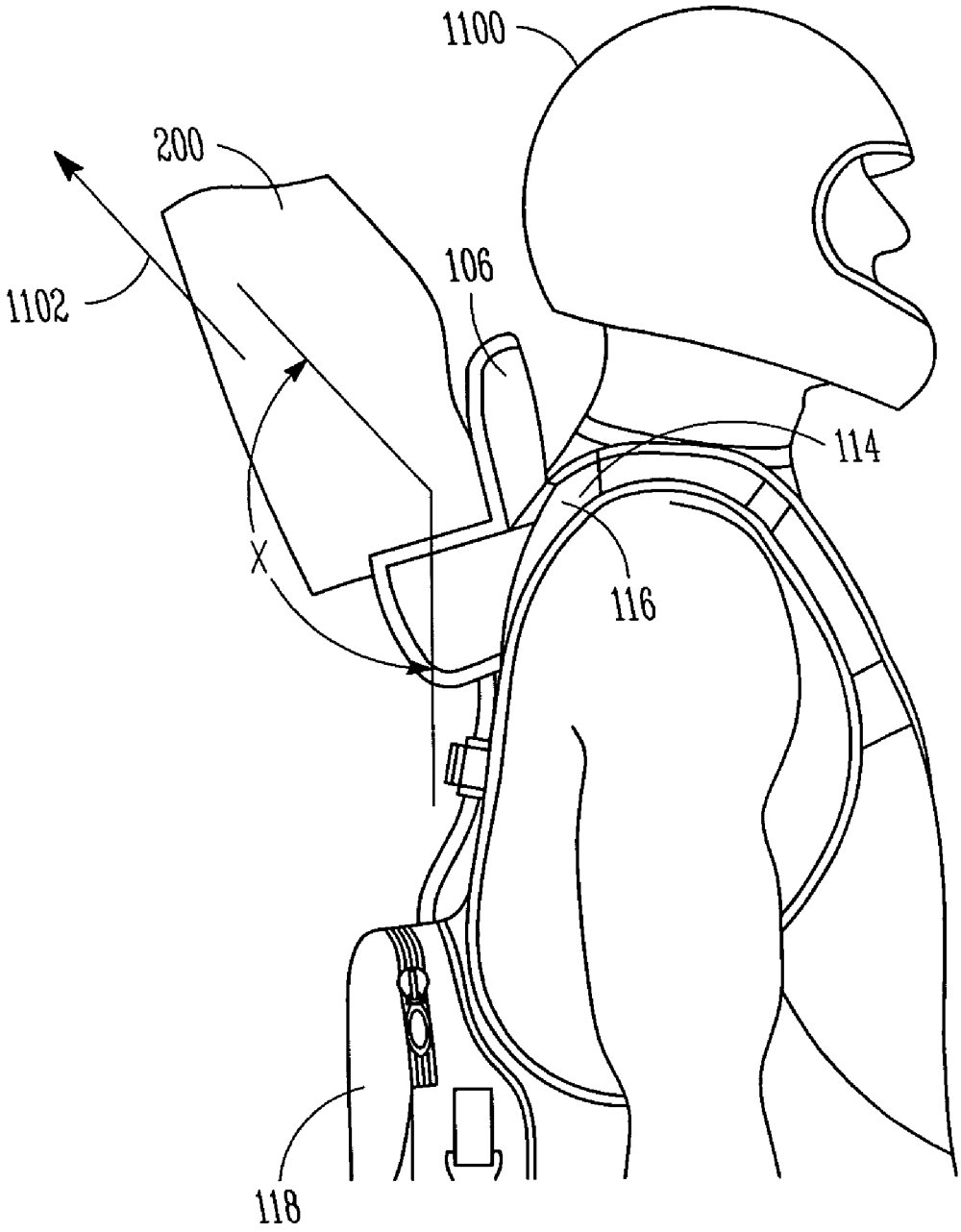

FIG. 10 shows one example of a method 1000 for deploying the inflatable bladder 200 shown in FIGS. 1-7C and 9A-9G2. While discussing the method 1000, reference will be made to these FIGS. 1-7C and 9A-9G2 as well as FIGS. 11A-E. At 1002, the inflatable bladder 200 is activated, for instance by triggering the activation housing 406 (FIG. 4) by the activator 408. The activation housing 406 opens the gas canister 402 allowing the compressed gas (e.g., air, nitrogen and the like) to move through the gas tube 202 into the inflatable bladder 200 (FIG. 2). As shown in FIG. 11A, as inflation begins the bladder 200 (phantom lines) is in the stored condition on the rescue harness 100 within the bladder container 106. The user has his hand on the activator 408 shown in FIG. 4, and has just triggered the inflation of the bladder 200. At 1004, the bladder 200 inflates and splits open the bladder container 106 (FIG. 11B). As described above, and shown in FIG. 2, the bladder container 106 includes a container upper portion 206 and container lower portion 208 closed with coupling features 210. The coupling features 210 split upon deployment of the bladder 200.

Figure 11C:
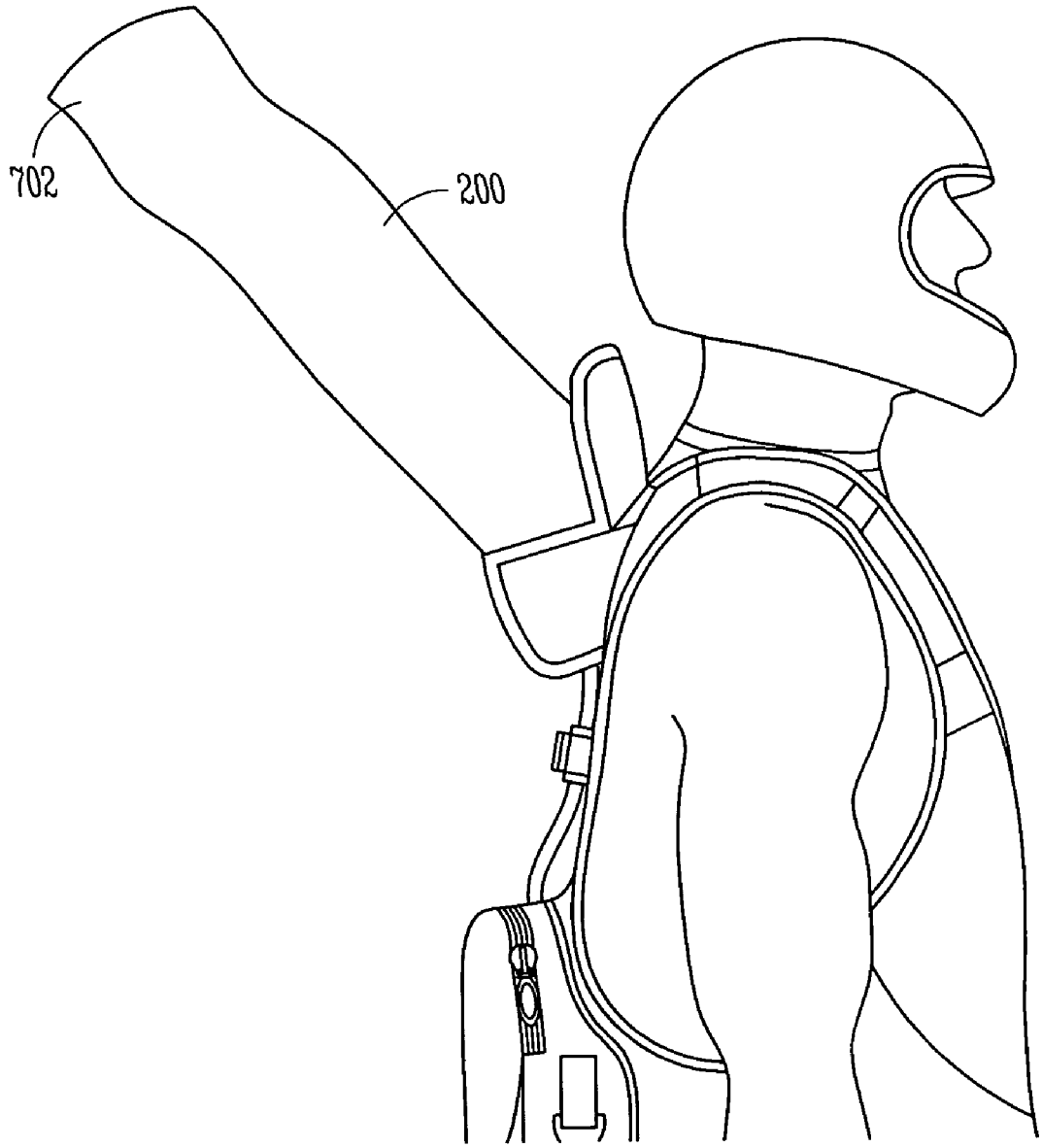

Referring to FIG. 11B, at 1006, the bladder 200 inflates in a first direction 1102 away from the harness neck portion 114 and head of the user 1100 into a first intermediate configuration shown in FIG. 11C. As shown in FIG. 11B, in one example, as the bladder 200 extends in the first direction 1102 it is at approximately 135 degrees (see quantity x in FIG. 11B) measured from a line extending between the harness upper back portion 116 and the harness lower back portion 118, and the bladder 200. Optionally, the bladder 200 inflates from the harness upper back portion 116 toward the harness lower back portion 118 (i.e., down the back of the rescue harness 100). In still another option, the bladder 200 inflates in any direction that avoids contact with the harness neck area 114 and the harness upper back portion 116, such as at an angle of 170 degrees relative to the line between upper back portion 116 and the lower back portion 118. As shown in FIG. 11C, the bladder 200 continues to unfold along the last made folds until it reaches a fully extended position (e.g., the first intermediate configuration) with the distal end 702 exposed and the bladder 200 is in a substantially straight orientation.

As described above and shown in FIG. 9F, the inflatable bladder 200 is folded along the width 926 of the bladder in one of the last packing steps. The inflatable bladder 200 thereby first opens longitudinally away from the rescue harness 100, specifically the harness neck portion 114 and the user's head 1100, by unfolding (e.g., unrolling) along the last made folds. Further, in the stored condition, the inflatable bladder 200 is optionally packed with the bladder leading edge 928 directed down from the upper back portion 116 toward the harness lower back portion 118, as shown in FIG. 9G1. During inflation, having the bladder leading edge 928 directed away from the harness neck portion 114 and the head of the user directs at least initial inflation away from these areas (e.g., toward the lower back portion 118) and supplements the unfolding of the bladder 200 longitudinally away as described above. As described below, additional features, such as deflectors, are included in examples of the rescue harness 100 to further direct the inflating bladder 200 away from the head of the user 1100 and the harness neck portion 114.

Figure 11D:
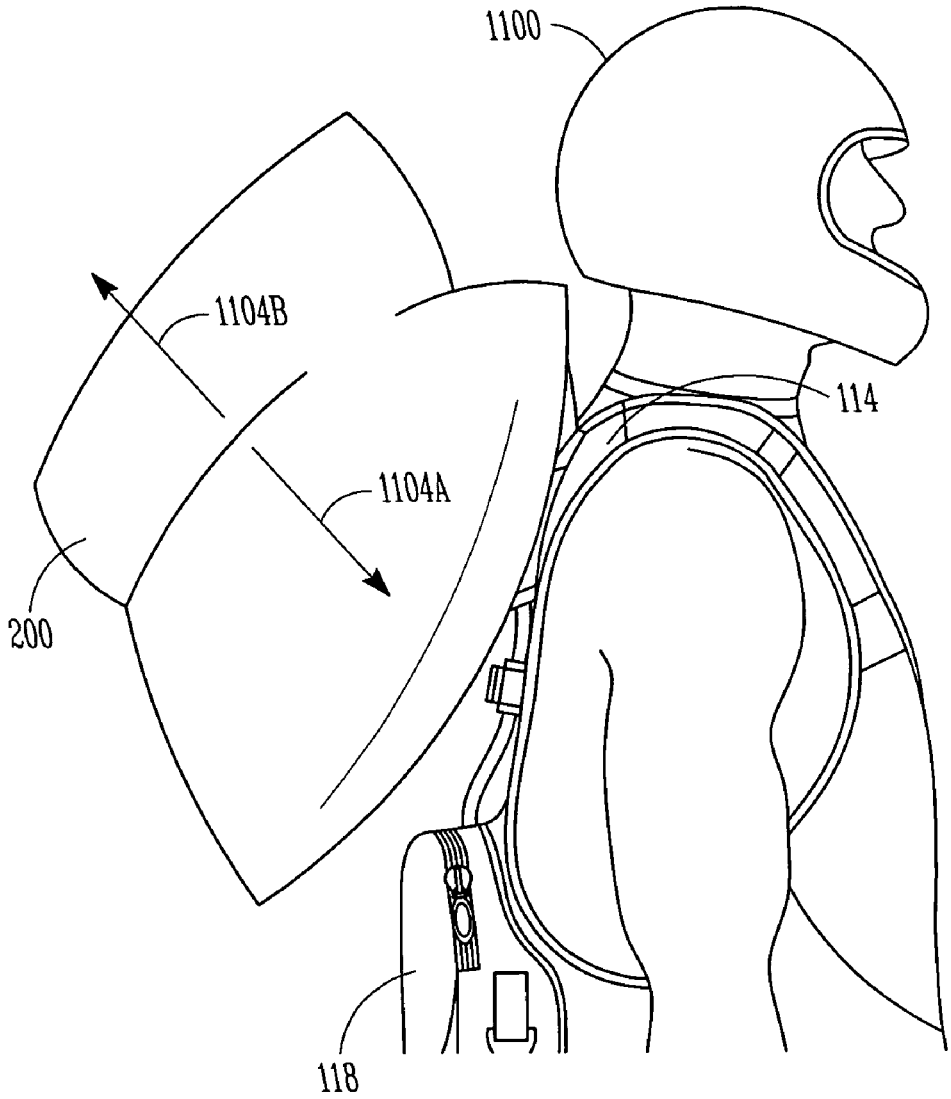

At 1008, the inflatable bladder 200 continues to inflate into a second intermediate configuration as shown in FIG. 11D. The bladder 200 inflates in at least a second direction, such as a direction substantially perpendicular to the first direction 1102 shown in FIGS. 11B, C. As shown, the bladder 200 extends in two directions 1104A, B. After the initial inflation described in steps 1004 and 1006, the bladder 200 rotates around the bladder joint 300 (See FIG. 3) toward the harness lower back portion 118. As described above with the example packing method 800, the first folds (relative to the width-wise folds along the width 926, See FIG. 9F) along at least the first and second folding lines 906, 912 extend from the bladder proximal end 302 to the bladder distal end 702 (FIGS. 3, 7 and 9A-E). After the width-wise folds are unfolded and the bladder 200 has been directed away from the harness neck portion 114 and the head of the user 1100 (e.g., the first intermediate configuration), the bladder 200 continues to deploy and unfolds at folding lines 906, 912 substantially across the back of the vest and the user (e.g., the second intermediate configuration).

Figure 11E:
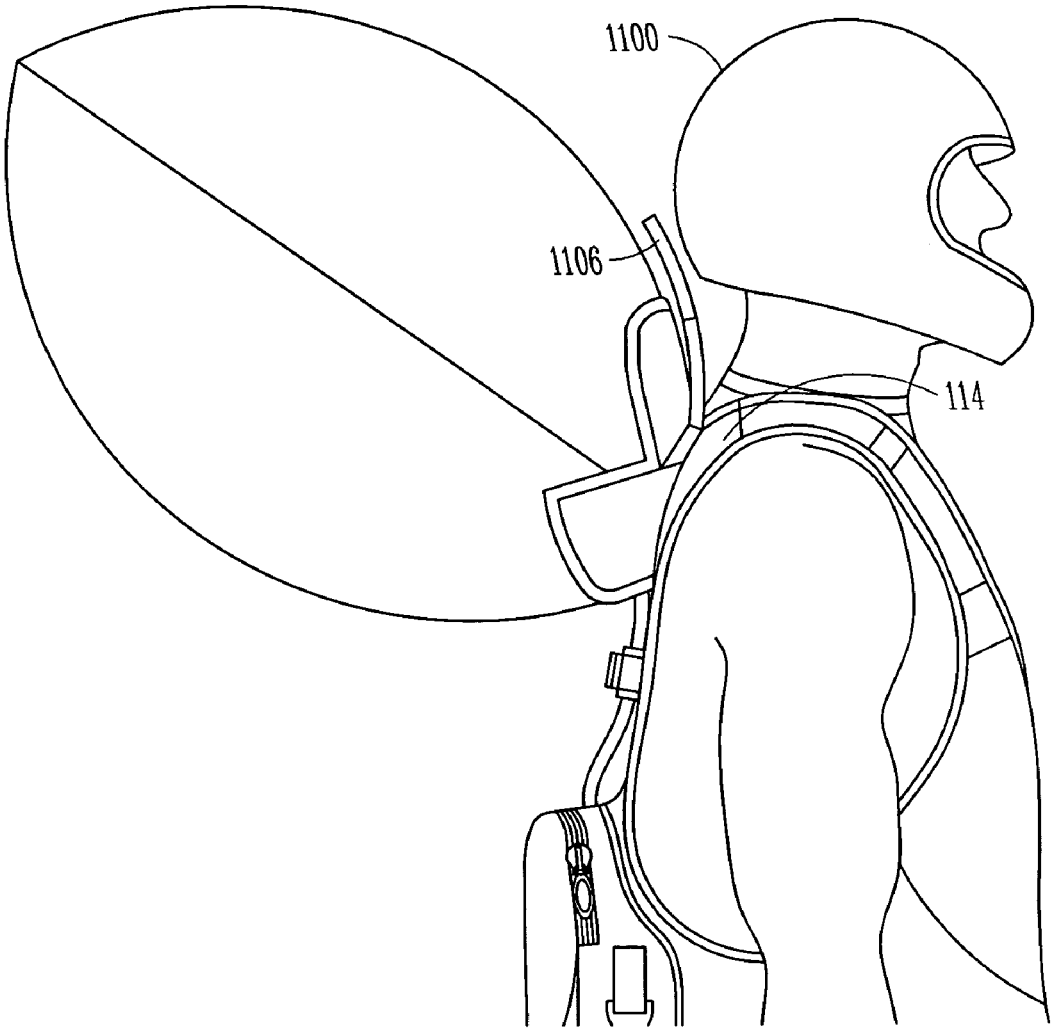

At 1010, the bladder 200 engages with the deflector 1106, and the deflector 1106 constrains movement of the bladder 200 toward the harness neck area 114 and the head of the user 1100 (See FIG. 11E). As shown in FIG. 7B the upper container portion 206 acts as the deflector 1106 (FIG. 11E) that engages with the inflatable bladder 200 as it deploys. The upper container portion 206 splits from the lower container portion 208 (FIG. 2), for instance, during step 1004. The upper container portion 206 is pushed toward the harness neck portion 114 by the inflatable bladder 200. The upper container portion 206 pushes back against the bladder 200 and assists in preventing movement (e.g., rotation) of the bladder 200 during inflation toward the harness neck portion 114 and the user's head 1100.

The deflector 1106 includes the deflector 700 shown in FIG. 7C in another example. As described above, the deflector 700 is a separate portion of the rescue harness 100 from the bladder container 106. The deflector 700 has a pliable or rigid construction that assists in preventing movement of the bladder 200 toward the harness neck portion 114 and the user's head 1100.

Figure 11F:
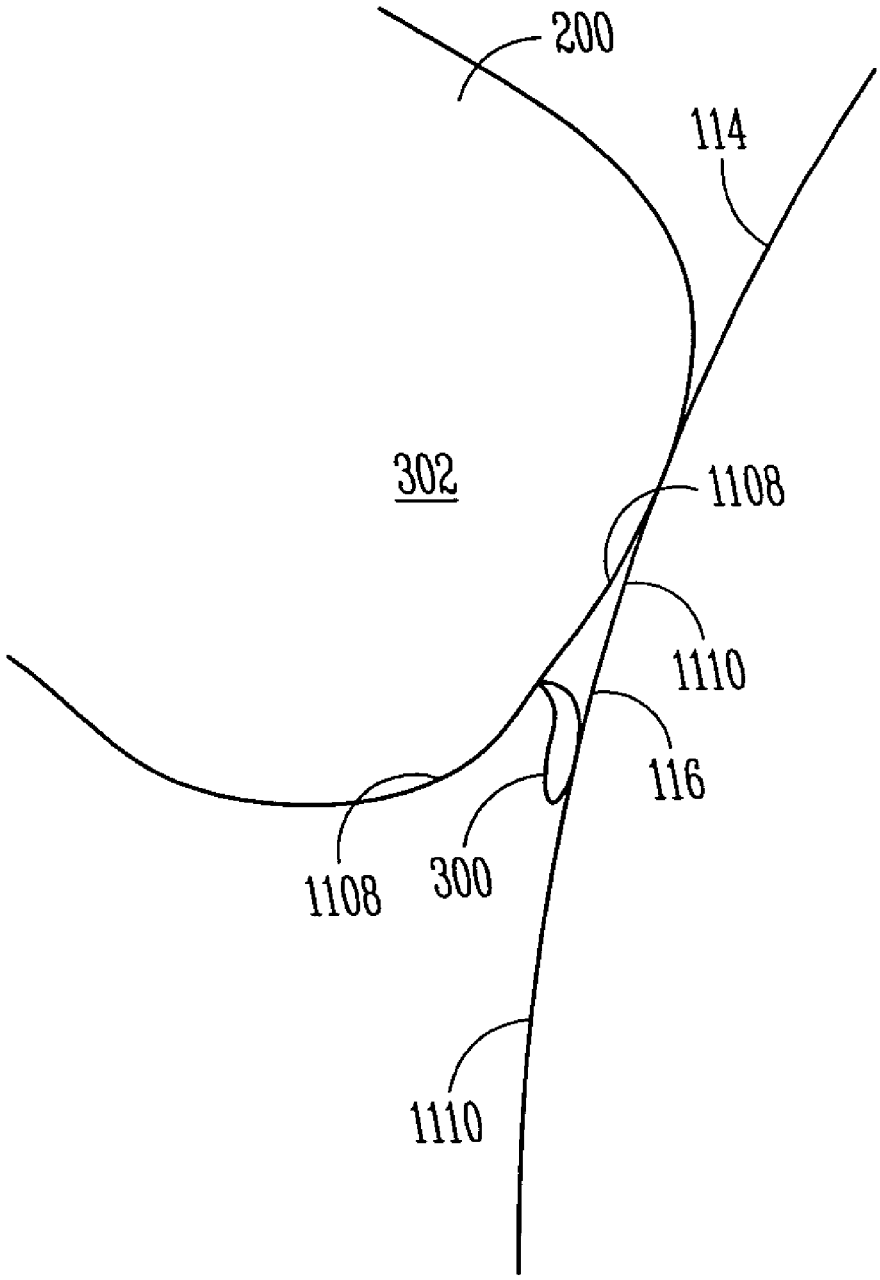

Several options for the method 1000 follow. In one example, directing the inflatable bladder 200 away from the user's head 1100 during inflation includes unrolling the inflatable bladder 200. The first bladder face 310 (FIG. 3, 7B) is nearer to the harness neck area 114 than the opposed second bladder face 500 (FIG. 5, 7B), and the first bladder face 310 is on the bladder exterior 930 in the stored condition (e.g., rolled condition) while the second bladder face 500 is on the bladder interior 932 as shown in FIG. 9G1. The venturi 502 coupled along the second bladder face 500 and the bladder interior 932 is thereby isolated from the harness neck portion 114 and the user's head 1100 during inflation as the bladder unrolls with the venturi 502 on the bladder interior 932. In other words, the inflatable bladder 200 is interposed between the venturi 502 and the harness neck portion 114 and the user's head 1100. In another example, the method 1000 includes constraining rotation of the bladder 200 toward the harness neck portion 114 and the head of the user 1100 (FIG. 11B) by engaging a substantially flat bladder geometry 1108 at the bladder proximal end 302 with the harness upper back portion 116 (See FIG. 11F). The bladder 200 is coupled by the bladder joint 300 to couple the bladder 200 with the rescue harness 100. The substantially flat bladder geometry 1108 and the substantially flat harness geometry 1110 engage to constrain rotation of the inflated bladder 200 toward the head of the user 1100. In still another example, the deflector 206, 700 is relied on by itself to isolate the head of the user 1100 and the neck from contact with the bladder 200. Optionally, the packing method as described herein is relied on exclusively to similarly isolate the head of the user 1100 and the neck from contact with the bladder during inflation. In a further example, the bladder 200 interposed between the head of the user 1100 and the harness neck portion 114, with the venturi 502 on the second bladder face 500, protects the head 1100 and the neck from violent contact with the venturi 502.

Figure 12:
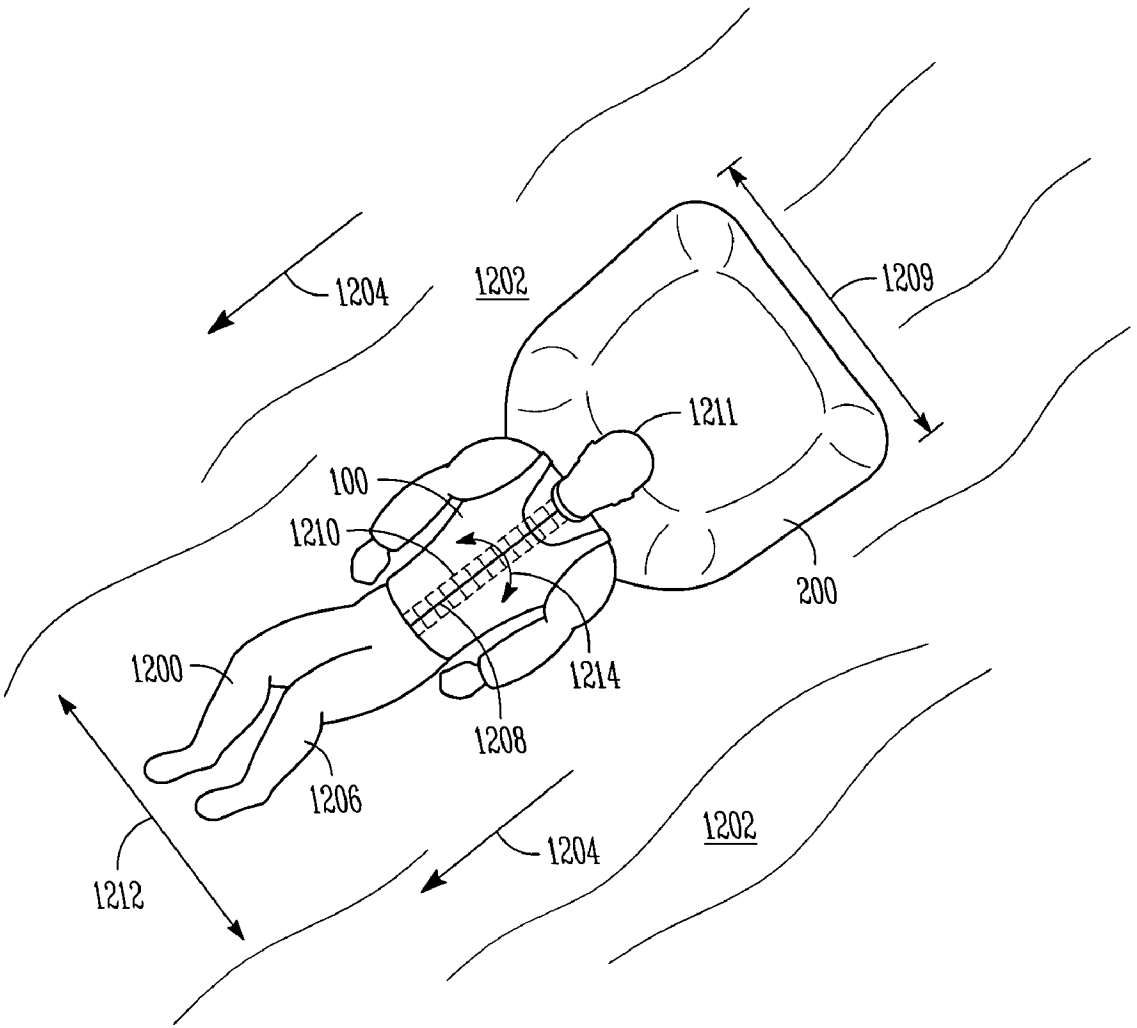
FIG. 12 is a top down view of a user with the rescue harness in a material slide having the inflatable bladder in a deployed condition.

As shown in FIG. 12, the bladder 200 is inflated (for instance, as part of method 1000) and the user 1200 of the rescue harness 100 is within a moving material slide 1202. In one example, the inflated bladder 200 acts as an anchor within the material slide 1202 because of its buoyancy and drags the user 1200 toward the surface of the material slide 1202. The user is thereby close to or on the surface of the material slide 1202 and can more easily extricate himself. The material slide continues to pull the user 1200 in the moving direction 1204 of the slide. Because the inflated bladder 200 acts as an anchor the material slide 1202 pulls the lower body portion 1206 of the user 1200 in the moving direction 1204 away from the bladder 200. The spine 1210 (shown in phantom lines) is correspondingly kept in a straight line 1208 and experiences less lateral stress along lines 1212. Further, the inflated bladder 200 helps to point the lower body portion 1206 and assists in preventing the user's head 1211 from striking any oncoming debris, such as trees, rocks and the like. Further still, having the inflated bladder 200 near the user's head 1211 provides at least some protection from debris, such as moving material in a material slide. The inflated bladder 200 absorbs some of the shock that would otherwise be experienced by the head 1211 if the bladder were not interposed therebetween.

Additionally, the width 1209 of the bladder 200 provides a wide surface that rides on top of the material slide 1202 and is resistant to rolling over itself. The spine 1210 correspondingly experiences less stress caused from torque 1214 (e.g., torque induced stress) as the spine is correspondingly rotated less. The inflated bladder 200 and the rescue harness 100 thereby may provide some stress relief to the spine 1210 of the user of the rescue harness 1200 during the material slide 1202.

The above described rescue harness allows for use of an inflatable bladder that opens near the head of the user to provide protection to the head and direct the lower body of the user down the material slide while leaving the head upstream and protected. The spine of the user experiences less stress in the material slide as the bladder cooperates with the material slide to keep the spine straight and free of torque induced stress.

The inflatable bladder is configured to quickly inflate and does so in a safe manner by opening away from the harness neck area and the head of the user. The head and neck of the user are thereby not violently contacted by the bladder during the rapid inflation. In one example, the packing method described herein including folding the bladder along its width in a later packing step ensures the bladder opens away from the head of the user. In another example, packing the bladder with the bladder leading edge directs at least initial inflation of the bladder away from the head of the user. Further, because the venturi is on an opposite side of the bladder from the head and the harness neck portion, the inflatable bladder provides a shock absorbing function for violent contact that could otherwise occur between the venturi and the head or neck.

Further the deflector, such as a portion of the bladder container or separate deflector provide an interposing barrier between the bladder and the harness neck portion and the head of the user. The deflector directs inflation of the bladder away from these locations, and assists in preventing movement of the bladder into the head of the user after deployment is completed, such as during movement through a material slide. Further still, the blunt contact between the bladder geometry at the bladder proximal end and the substantially flat surfaces of the back of the rescue harness assists in preventing engagement of the bladder with the head of the user.

Additionally, because the bladder is rotatably coupled to the rescue harness the user can continue with activities after deployment, including attempting to get out of a material slide. The user may freely move his torso and arms as the bladder is movably coupled and can rotate away from interference with the body of the user. Further, the bladder can rotate out of engagement with debris such as tree limbs, rocks and the like to avoid becoming snagged on such items to allow the user to quickly navigate broken terrain.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A method for using a rescue harness comprising:

inflating an inflatable bladder, the inflatable bladder coupled near an upper back of a user; and directing the inflatable bladder away from a head area of a user during inflation including:

unrolling the inflatable bladder into a first intermediate configuration, the inflatable bladder unrolling in a first direction along one or more first folds while the inflatable bladder remains folded along the one or more second folds, the one or more first folds guiding unrolling of the inflatable bladder away from the head area, unfolding the inflatable bladder into a second intermediate configuration from the first intermediate configuration, the inflatable bladder unfolding in a second direction along one or more second folds, and the second direction is substantially perpendicular to the first direction.

2. The method for using the rescue harness of claim 1, wherein directing the inflatable bladder away from the head area during inflation includes directing the inflatable bladder down a back of the user toward a lower back of the user.

3. The method for using the rescue harness of claim 1, wherein unrolling the inflatable bladder into a first intermediate configuration includes unrolling the inflatable bladder where a bladder leading edge of the inflatable bladder in a rolled configuration prior to unrolling is directed away from the head area.

4. The method for using the rescue harness of claim 1, wherein directing the inflatable bladder away from the head area during inflation includes constraining rotation of the inflatable bladder toward the head area.

5. The method for using the rescue harness of claim 4, wherein constraining rotation of the inflatable bladder toward the head area during inflation includes interposing a deflector between the inflatable bladder and the head area.

6. The method for using the rescue harness of claim 1 further comprising interposing the inflatable bladder between the head area and a venturi housed on the inflatable bladder during inflation.

7. The method for using the rescue harness of claim 1 further comprising constraining rotation of the inflatable bladder toward the head area, the inflatable bladder having a substantially flat bladder shape at a bladder joint in an inflated condition, the flat bladder shape engaging with a flat harness shape to constrain rotation of the inflatable bladder toward the head area.

8. The method for using the rescue harness of claim 1, wherein inflating the inflatable bladder includes inflating the inflatable bladder in a material slide, and the inflatable bladder is configured to buoyantly rise to a material slide surface while the body of the user is moved ahead of the inflatable bladder in a moving direction of the material slide, and a spine of the user is pulled in a straight line by the inflatable bladder in the material slide.

9. The method for using the rescue harness of claim 8, wherein inflating the inflatable bladder includes inflating the inflatable bladder in the material slide and an inflatable bladder width greater than the shoulder width of a user substantially prevents rolling of the inflatable bladder and corresponding substantially prevents torque induced stress on a spine of the user.

10. A method for making a rescue harness comprising:

coupling a bladder proximal end of an inflatable bladder to a harness at a bladder hinge joint, the bladder proximal end is near a harness upper back portion, a bladder distal end is rotatable relative to the bladder joint;

coupling an inflation trigger mechanism with an inflation system, the inflation system coupled with the inflatable bladder; and packing the inflatable bladder into a stored position, packing including:

folding the inflatable bladder into a first packing configuration including folding the inflatable bladder along one or more longitudinal fold lines extending from the bladder proximal end to the bladder distal end, folding the inflatable bladder from the first packing configuration into a second packing configuration including folding the inflatable bladder along one or more perpendicular fold lines while the inflatable bladder is folded along the one or more longitudinal fold lines, the one or more perpendicular fold lines substantially perpendicular to the one or more longitudinal fold lines, and positioning the inflatable bladder in a folded configuration adjacent the harness upper back portion, the inflatable bladder including a leading edge extending along one or more of the perpendicular fold lines, the leading edge directed toward a harness lower back portion.

11. The method for making the rescue harness of claim 10, wherein folding the inflatable bladder along the one or more longitudinal fold lines includes folding a first bladder flap under a bladder center portion with a first longitudinal fold line extending adjacent to a venturi first end of a venturi housed on the inflatable bladder.

12. The method for making the rescue harness of claim 11, further comprising folding a second bladder flap over the bladder center portion, the second bladder flap folded along a second longitudinal fold line extending adjacent to a second venturi end, the second bladder flap concealing at least a portion of the venturi and the first venturi end is exposed.

13. The method for making the rescue harness of claim 10, wherein folding the inflatable bladder along one or more perpendicular fold lines includes rolling the inflatable bladder toward the bladder proximal end.

14. The method for making the rescue harness of claim 13, wherein rolling the inflatable bladder toward the bladder proximal end includes positioning a first bladder face on a bladder exterior in the folded configuration, the first bladder face is nearer a harness neck area than an opposed second bladder face in an inflated condition, and positioning the second bladder face on a bladder interior in the folded configuration.

15. The method for making the rescue harness of claim 10, wherein folding the inflatable bladder along one or more perpendicular fold lines includes positioning the inflatable bladder in the folded configuration over a venturi mounted on the inflatable bladder.

16. The method for making the rescue harness of claim 10 further comprising coupling a bladder deflector with the harness, the bladder deflector is coupled between the bladder proximal end and a harness neck area, the bladder deflector is sized and shaped to constrain movement of the inflatable bladder in an inflating condition toward the harness neck area.

17. The method for making the rescue harness of claim 16, wherein coupling the bladder deflector with the harness includes coupling the bladder deflector over the inflatable bladder in the stored position, the bladder deflector is sized and shaped to hold the inflatable bladder adjacent the harness upper back portion.

* * * * *